US008491312B2

(12) United States Patent
Rudisill et al.

(10) Patent No.: US 8,491,312 B2
(45) **Date of Patent: *Jul. 23, 2013**

(54) FLEXIBLE MAGNETIC INTERCONNECTS

(75) Inventors: Charles Albert Rudisill, Apex, NC (US); Daniel John Whittle, Bellingham, WA (US)

(73) Assignee: Apex Technologies, Inc., Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/456,271

(22) Filed: Apr. 26, 2012

(65) Prior Publication Data

US 2012/0208378 A1 Aug. 16, 2012

Related U.S. Application Data

(62) Division of application No. 12/698,731, filed on Feb. 2, 2010, now Pat. No. 8,187,006.

(60) Provisional application No. 61/206,609, filed on Feb. 2, 2009, provisional application No. 61/279,391, filed on Oct. 20, 2009.

(51) Int. Cl.
*H01R 11/30* (2006.01)

(52) U.S. Cl.
USPC ..... 439/39

(58) Field of Classification Search
USPC ..... 439/39, 40, 928; 362/398, 249.02, 362/249.06, 249.14; 434/224; 361/735; 446/71, 446/92
See application file for complete search history.

(56) References Cited

U.S. PATENT DOCUMENTS

| | | | | |
|---|---|---|---|---|
| 3,237,341 | A * | 3/1966 | Janning | 446/91 |
| 3,254,440 | A * | 6/1966 | Duggar | 446/92 |
| 3,447,249 | A * | 6/1969 | Greger | 434/224 |
| 3,576,936 | A * | 5/1971 | Fischer | 434/224 |
| 3,594,689 | A * | 7/1971 | Hopt et al. | 439/292 |
| 4,532,579 | A * | 7/1985 | Merryman | 362/239 |
| 6,062,937 | A * | 5/2000 | Kikuchi | 446/91 |
| 6,851,831 | B2 * | 2/2005 | Karlicek, Jr. | 362/249.06 |
| 7,080,927 | B2 * | 7/2006 | Feuerborn et al. | 362/368 |
| 7,322,873 | B2 * | 1/2008 | Rosen et al. | 446/91 |
| 7,541,907 | B2 * | 6/2009 | Wang et al. | 335/305 |
| 7,828,556 | B2 * | 11/2010 | Rodrigues | 439/38 |
| 7,846,002 | B1 * | 12/2010 | Mikesell et al. | 446/91 |

* cited by examiner

*Primary Examiner* — Neil Abrams
(74) *Attorney, Agent, or Firm* — James G. Passé; Passé Intellectual Property, LLC

(57) ABSTRACT

A flexible magnetic interconnect is disclosed. In one embodiment, an apparatus includes a module having a recess therein. A magnetic structure is moveable within the recess and a flexible circuit cooperates with the module to retain the magnetic structure within the recess. Movement of the magnetic structure is caused by magnetic attraction between the magnetic structure and an external magnetic structure. The flexible circuit includes a compliant contact, which changes shape by movement of the magnetic structure.

20 Claims, 22 Drawing Sheets

SECTION C-C

SECTION A-A

SECTION B-B

FLEXIBLE MAGNETIC INTERCONNECTS

CROSS-REFERENCE TO RELATED APPLICATIONS

This application is a divisional of U.S. Pat. No. 8,187,006 issued on May 29, 2012 which claims the benefit of U.S. Provisional Application No. 61/206,609 filed Feb. 2, 2009, which is hereby incorporated by reference. This application also claims the benefit of U.S. Provisional Application No. 61/279,391 filed Oct. 20, 2009, which is hereby incorporated by reference.

FIELD OF THE INVENTION

The present invention relates generally to electrical connectors and, more particularly, to flexible magnetic interconnects.

BACKGROUND OF THE INVENTION

Electrical interconnections, such as between individual electronic and lighting modules to form a larger system, have typically been accomplished through the use of conventional connector systems such as pins, sockets, pressure connections, and other commercially available connector styles used to make board-to-board, board-to-cable, module-to-board and cable-to-cable or other separable connections. More permanent electrical interconnections may be formed with solders or conductive adhesives. These connection approaches have many limitations including, cost, awkward assembly techniques, bulky appearance, large size, restrictions on the shape and size of interconnected modules, fragility, alignment tolerances, difficulty in removing individual elements of extended assemblies and damage susceptibility. Accordingly, a need exists for a robust system that can be used to electrically and mechanically connect these types of modules.

Other connectors also have disadvantages. For example, conventional pin and socket type interconnection methods are restricted in the shapes possible and in the direction of approach in mating assemblies. Accordingly, the need exists for systems and/or methods that provide electrical and/or mechanical connection of modules that, in various embodiments, are exemplified by one or more of the following characteristics: relatively inexpensive, durable, low profile, small volume, easy to assemble and disassemble, easily reconfigured when part of an extended array, mechanically self-supporting (i.e., having no additional external parts required to maintain contact force), and may be adapted readily to different module shapes and sizes which may be assembled into a large variety of extended assemblies.

Conventional "breakaway" magnetically retained type connectors utilize pinned or discrete metal formed contacts with an adjacent magnetic feature to retain the connector. In some conventional connectors, a contact insertion force or preloading characteristic of spring contacts must be overcome in order to make an electrical connection. In addition, zero insertion force electrical connections typically require a secondary clamping or other process to make an electrical connection, even on multiple contact positions and arrays. In arrayed contact configurations, some connector systems apply a distributed force and use elastic or spring elements to overcome mechanical tolerance differences and generate individual contact pair forces across the array of contact pairs. A need exists for a connector system that overcomes one or more of these shortcomings.

SUMMARY OF THE INVENTION

The present invention is designed to address at least one of the aforementioned problems and/or meet at least one of the aforementioned needs.

Apparatuses, systems and methods are disclosed herein, which relate to flexible magnetic interconnects. In one embodiment, an apparatus is comprised of a module having a recess therein. A magnetic structure is moveable within the recess and a flexible circuit cooperates with the module to retain the magnetic structure within the recess. In one embodiment, movement of the magnetic structure is caused by magnetic attraction between the magnetic structure and an external magnetic structure.

In one embodiment, the flexible circuit includes a compliant contact, which changes shape by movement of the magnetic structure.

In one embodiment, a system is comprised of a first module and a second module. The first module includes a first magnetic structure and a flexible circuit, and the second module includes a second magnetic structure and a circuit. The first magnetic structure is moveable within the first module. A magnetic attraction between the first magnetic structure and the second magnetic structure causes the flexible circuit of the first module to change shape. In one embodiment, the magnetic attraction holds the flexible circuit of the first module and the circuit of the second module in mechanical contact with one another. In one embodiment, an electrical connection is formed between the flexible circuit of the first module and the circuit of the second module. In one embodiment, the electrical connection is maintained as the first module and second module are moved relative to one another.

In one embodiment, a method comprises the steps of: (1) providing a first module including a first magnetic structure and a first flexible circuit, wherein the first magnetic structure is moveable within the first module; and, (2) applying a magnetic force, thereby causing the first magnetic structure to move and the first flexible circuit to temporarily change shape.

Embodiments of the methods and systems disclosed herein include those for systems comprising two or more modules that are electrically connected using magnetic force. The magnetic force may also be used to assist in the mechanical connections between modules and/or to attach them to other structures. The modules may include those that have light sources and others that do not include light sources. The modules that do not include light sources may be used to provide electrical and/or mechanical continuity to other modules. Larger, substantially planar or three-dimensional structures can be produced by combining a plurality of modules.

In embodiments of the methods and systems disclosed herein, the magnetic force may come from attraction of permanent magnets to other permanent magnets, or from the attraction of permanent magnets to a magnetic material that is not a permanent magnet.

In embodiments of the methods and systems disclosed herein, a magnetic structure may be positioned directly behind a compliant electrical contact. In this disclosure, the magnetic structure may be comprised of a permanent magnet or of a material attracted to a permanent magnet. In embodiments of the methods and systems disclosed herein, compliant contacts may be comprised of a flexible printed circuit having metallic circuitry and contacts formed on one or more planes of electrically insulating substrates. In further embodiments of the methods and systems disclosed herein, the modules may include LEDs and other electrical components on one side of a flexible printed circuit and electrical contacts on the other side, a light guide with recesses for the LEDs and other electrical components and for magnetic structures in which the flexible printed circuitry is applied to an outer edge or edges of the light guide. In embodiments, edges of a compliant contact attached to an outer surface of a module may be adhesively attached to provide a sealed structure in which only the outer peripheral contact circuitry is exposed to the external environment. In embodiments in which the compliant contacts are substantially flush with the edge or edges of a module, planar systems may be constructed in which a module that is connected to all adjacent modules can be removed in a direction perpendicular to the plane without removing other modules. In embodiments with substantially flush surface contacts, the physical separation between lighting modules can be made small relative to the scale of the lighting modules.

In further embodiments of the methods and systems disclosed herein, modules may comprise compliant contacts and magnetic structures that are free to rotate or translate in one or more dimensions. Such movement may be useful in compensating for mechanical differences or motion between multiple interconnected modules that prevent continuous mechanical contact between modules. In embodiments of the methods and systems disclosed herein, modules may be comprised of magnetic structures and compliant contacts that allow modules to rotate or translate relative to each other without breaking electrical continuity between modules.

In embodiments of the methods and systems provided herein, modules may comprise magnetic structures and compliant contacts that provide simultaneous electrical and mechanical connection in more than one direction or that connect more than two modules together.

In embodiments of the methods and systems disclosed herein, the compliant contact may be comprised of a metal foil or wire. The term "flexible circuit" (also called "flex circuit"), as used for purposes of this disclosure, includes flexible printed circuitry having electrically conducting lines on electrically non-conducting flexible substrates and electrically conducting flexible members such as metal foils or flexible films which include electrically conducting fillers such as carbon or metals. Embodiments that describe a flexible printed circuit should be understood to also illustrate embodiments in which any other type of flexible circuit is substituted for the printed flexible circuit. Embodiments that describe a flexible circuit that is not a flexible printed circuit should be understood to also illustrate embodiments of any other type of flexible circuit including flexible printed circuits. For a flexible circuit to be considered "flexible" in a particular application means that it is capable of being moved by the motion of the magnetic structure under a magnetic force from another module or external source in that application. In addition to the metal circuitry used with flexible printed circuitry, electrically conducting polymers, inks or other electrically conducting films may be used to fabricate compliant contacts. Compliant contacts of any form may be mechanically supported or integrated into printed circuit boards which include polymeric, epoxy, ceramic or other materials known in electronic packaging. As used herein for the purposes of this disclosure, a "compliant contact" is a contact that has sufficient flexibility to bridge mechanical tolerances in a particular design implementation by changing shape through conforming or deforming to overcome the mechanical separation. Magnetic structures used in embodiments disclosed herein may be shaped to influence contact geometries and associated Hertz stress of a compliant contact pair. The shape of the magnetic structure may contribute at least temporarily to the Hertzian contact stress profile through deformation of the compliant contact. Other structures including asperities, permanent deformations, and additional conducting material attached to the contact surface may be incorporated into one or more contact surfaces to contribute to the Hertzian contact stress profile as is well-known in the art of electrical interconnects. Since the magnetic structures are not required to directly participate in electrical conduction, there is no need to apply any metallic coatings or restrict the choice of magnetic structures to those that are electrically conductive. This separation of magnetic force and electrical conduction allows the use of extended magnetic structures that are associated with multiple electrically-isolated contact pairs in a system.

For the purposes of this disclosure, compliant contacts are not required to be characterized by reversible elasticity. That is, a change in shape resulting from the movement of the magnetic structure may include a permanent component and a temporary component. Embodiments of this disclosure include those insensitive to mechanical creep or modulus changes in the contact. In order to have a connection benefiting from this compliancy at least one contact in a mating pair needs to be a compliant contact and the other contact can be a non-compliant, or rigid, contact. It is not necessary to have both halves of a contact pair to include compliant contacts.

As used herein for the purposes of this disclosure, the term "module" should be understood to mean any individual element of the system that may be connected electrically and mechanically to a separate unit using magnetic force. A "system" consists of two or more modules connected together. A "light module" should be understood to be a module that includes an element that radiates electromagnetic energy. The element may be a packaged or unpackaged light emitting diode, or LED, with an inorganic or organic active element, a lamp, an electroluminescent material or any other material or component with an electro-optic energy conversion. The spectrum of electromagnetic energy associated with a light module is not restricted to the visible region, but may consist of electromagnetic energy with frequencies outside the visible region. A "light system" includes at least one "light module" connected to another module under magnetic force; the other module does not have to be a "light module." Examples of modules that are not "light modules" include electrical power source or data connectors, and modules that are used to extend the electrical and/or mechanical extent of any system.

As is well known in the art, magnetic forces may exist between pairs of magnets and between a magnet and a material attracted to a magnet. Magnets and materials attracted to magnets comprise rare earth and ferromagnetic materials. Rare earth magnets comprise neodymium and samarium-cobalt alloys. Ferromagnetic materials comprise iron, nickel, cobalt, gadolinium and alloys comprised of these materials such as alnico. The properties of the poles or magnets are also well-known, as is the ability to form magnets from cast and sintered material or magnetic particle filled elastomers and polymers. As a result, as used herein for the purposes of this disclosure, the term "magnetic structure" or "magnetic material" should be understood to include either a magnet or a material attracted to a magnet. A magnetic structure as used herein for the purposes of this disclosure may also include the combination of at least one magnet and at least one ferromagnetic material. The ferromagnetic material in such a combination may be used to influence the distribution of the magnetic flux lines of the magnet. The ferromagnetic material in such a combination may also be used to shape contact geometries. Although not specifically shown in the figures, it is understood that in addition to "permanent magnets," "temporary magnets" may be created by magnetic induction to create magnetic forces that could be used with the compliant contacts illustrated. Unless there is specific mention to orientation of magnetic poles, it should be understood that at least one or the other of the two magnetic structures creating an electrical contact pair from a magnetic attraction is a magnet. Due to the interchangeability of which element in the pair is a magnet, it should be understood for the purposes of this disclosure that a description of a contact pair in which one magnetic structure is described as a magnet and the other as a magnetic material also discloses an equivalent structure in which the materials of the magnetic structures of both halves are switched. In addition, a magnetic material in embodiments discussed herein may be replaced with a magnet if one of the magnets in a contact pair is free to reorient magnetic poles to create an attractive force, or is by other means mechanically oriented such that there is magnetic attraction between the adjacent magnetic poles.

In embodiments of the methods and systems disclosed herein, there is no requirement for rigid printed circuit boards, rigid or resilient electrical contact structures, stiff electrical contact support structures or housings. In addition, the design of flexible printed circuit boards and other compliant contact structures may be readily customized somewhat independently from the design of the larger mechanical structure of the modules. This ability to accommodate changes allows for flexibility in design and tooling flexibility. Since electrical contact mating pairs can be designed to function substantially independently, efficiencies in designing, fabricating and testing different composite assemblies from a small number of component designs may be gained. Cost efficiencies may be gained in the nesting or "panelization" of the flexible printed circuits, fabrication of mechanical structures for modules and standardization of a limited number of parts.

In one exemplary application, methods and systems for creating electrical interconnection between discrete lighting devices or modules are provided for fabricating assemblies of planar and three-dimensional structures utilizing magnetic force. Individual modules may be of virtually any flat or compound three-dimensional shape. The modules utilize magnetic structures and compliant electrical contact pads to provide electrical contact force. The magnetic forces can also be used to mechanically retain the modules in the desired shape. The interconnection method and system allows modules to be assembled, disassembled and reconfigured into extended structures without requiring tight mechanical tolerances on individual modules. Embodiments of the disclosed method and system may be applied in decorative and architectural lighting and signage. They may also be applied in other areas of electronic packaging and system assembly.

In embodiments of the methods and systems disclosed herein, planar lighting modules may emit light from both major surfaces and minor surface sides, and modules may be partially transparent if desired, and may use inexpensive top-emitting LEDs or direct-chip-attached LEDs. Modules are easily customizable to the number of LEDs, contact pad arrangements, auxiliary electrical components included, etc. Modules using light guides, "direct" viewing of light sources, or cavities may be utilized. Lighting modules may include reflecting elements, scattering elements or other optical films or features that affect the character, direction or color of the light from the light sources.

In embodiments of the methods and systems disclosed herein, individual lighting modules may be connected to one another to form self-supported two- or three-dimensional lighting systems. These systems may be designed to hang vertically like a linear chain or a two-dimensional curtain or other three-dimensional structure. Modules may have contacts with continuous circular symmetry that may rotate about an axis while maintaining electrical and mechanical contact. Modules may also have contact arrays that provide different connections when one module is translated or rotated relative to an adjacent module. Individual modules may also be attached mechanically, or both mechanically and electrically to specialized one-, two-, or three-dimensional modules that provide electrical power or signals and mechanical support. The contacts to modules may be designed to be electrically isolated until magnetic force is applied by coming in contact with an adjacent module.

In embodiments illustrating the inventive concept of this disclosure, virtually any shape may be produced and interconnected (squares, trapezoids, triangles, curved shapes, spheres, tessellated patterns, three-dimensional shapes (corners, tubes, etc.)). Modules may be designed to be easily separable and reconfigured, including the ability to remove modules from an array without disconnecting multiple modules. Arrays of modules may be self-supporting when modules are assembled in arrays. Since the modules are attracted to one another by magnetic force and electrical interconnection is accomplished by magnetic force, no external pressure or mechanical force (and associated mechanical parts to apply and maintain such force) is required to make electrical connections between modules.

In an illustrative embodiment, the electrical and mechanical interconnection between multiple modules may include a magnetic force from a magnet or magnets located substantially behind the contact pads of flexible, compliant circuitry. This configuration provides a component of contact force directly at the contact pair interface of two modules. The compliant contacts may be formed integrally on a flexible printed circuitry having lighting or other electrical elements, or may be created from a separate flexible contact element attached to a substrate. The contact pad for purposes of this disclosure means the location at which electrical contact is made between modules through the inventive concepts of this disclosure.

Other objects, features, embodiments and/or advantages of the invention will be apparent from the following specification taken in conjunction with the following drawings.

DETAILED DESCRIPTION

In some embodiments, the modular electrical interconnection methods and systems provided in this disclosure utilize permanent magnets in combination with flexible or compliant electrical circuit substrates or localized flexible contacts on a rigid substrate. The flexible/compliant electrical contact structures, when mated, are located substantially between permanent magnets of opposing modules, or between magnets on one module and ferromagnetic material on an opposing module. The attraction of opposing magnets of adjacent modules (or magnets and ferromagnetic areas), compresses the contact pads of the flexible circuitry, thus generating contact force for electrical interconnection, and also provides some attractive force to mechanically retain the modules together. Systems made from these modules can be easily and reversibly assembled. No elastic properties of the contact system are required for reliable functioning of this connector system. The electrical contacts are constantly compressed by magnetic force, which negates the need for generating and sustaining contact pressure through the elastic properties of components or structural properties of supporting materials in the contact system. A large variety of configurations of permanent magnets, ferromagnetic material, and flexible circuit contacts are possible, a number of which are described below. These descriptions are not meant to be restrictive of the general inventive concept disclosed, only to provide illustrations of how the inventive concept may be employed.

Figure 1:
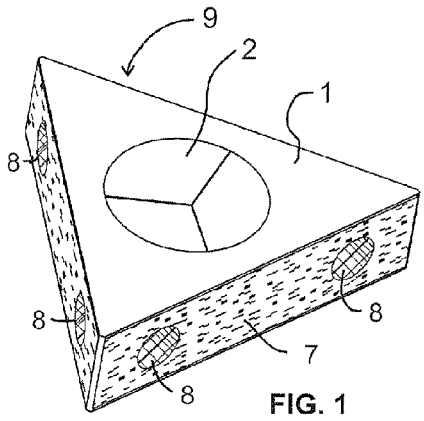
FIG. 1 is a diagrammatic representation of an isometric view of a planar lighting module, which is used to describe an exemplary embodiment of the present invention.
Figure 2:
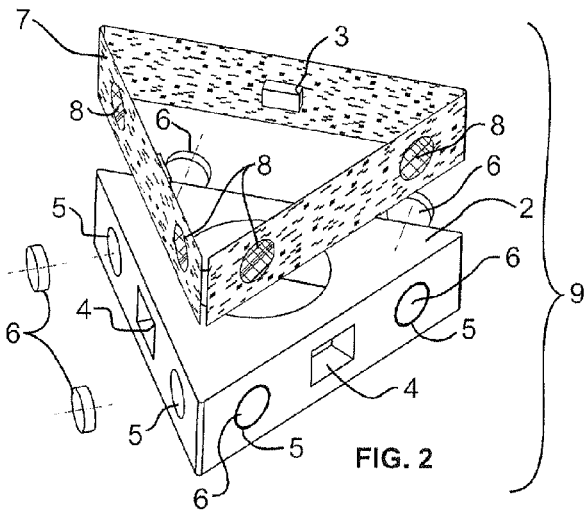
FIG. 2 is an exploded view of the planar lighting module of FIG. 1.

Referring to FIGS. 1 and 2, for the purposes of discussion, this example depicts a planar lighting module 9 (where FIG. 2 is an exploded view of FIG. 1) with a transparent molded prism/light guide structure 1 including reflecting/diffusing means 2 that will direct light to the viewing direction (generally perpendicular to the module surface) when light from a light source or sources such as LED 3 is directed into the prism/light guide 1.

Reflecting/diffusing means 2 includes pits, facets, periodic or random roughness or any other changes in geometry or optical properties of a structure that disturb the uniform propagation of light rays. The reflection/diffusing means may redirect light through changes in the optical characteristics or geometry at the interface between two media at the surface or in the volume of a structure. Mirrors, prisms, pits, bumps and gratings of any size, orientation or distribution, as well as composites characterized by non-uniform refractive indices, are representative examples of reflecting/diffusing means. Reflecting/diffusing means may produce diffuse scattering of light due to air bubbles and particles such as metal, metal oxides, stearates, minerals including talc or other compounds distributed within another material as is well known in the art. Reflecting/diffusing means may also include structures and materials that are used to redirect light in specific directions or within a preferred range of angles or directions.

The prism/light guide 1 in FIG. 2 has LED clearance features 4 to provide pockets for three LEDs 3, and six magnet recesses 5 large enough to accept cylindrical permanent magnets 6. The size of the pockets 4 are slightly larger than the magnets 6 such that the magnets 6 are free to rotate about an axis perpendicular to the plane of the disc and translate in three dimensions within the pocket, but are constrained to the position of the contact pads 8. As shown in this figure, the plane of the disc magnet 6 is parallel to the flat sides having circular shape. The direction perpendicular to the plane of the disc is parallel to the symmetric axis of the cylinder.

Also included is a flexible printed circuit assembly 7, fabricated from substrate materials such as polyimide or polyester with electronic circuitry thereon to connect in a series and/or parallel electrical configuration to the LEDs 3, and/or other electronic components such as current limiting resistors. The flexible circuit 7 includes contact pads 8 located on the outer surface of the flexible circuit, which are positioned opposite the permanent magnets 6. Contact pads 8 are fabricated on the flex circuit and may be plated with nickel, gold, palladium over base copper or other materials as is known in the printed circuit industry. The contact surfaces may be treated to contain asperities or other structures or coatings to increase contact reliability as is well-known in the art.

Flex circuit assembly 7 may be attached to the vertical edges of light guide 1 using pressure sensitive adhesive, thermally activated adhesives, solvent bonding, and/or mechanical means such as tabs, pins, heat staking, or other adhesive or mechanical means. One end of the flex circuit may alternately or additionally be attached to another end of the flex circuit to hold it onto the edge by a resulting compressive force. The flexible circuit is fixed by any of these means to a face or faces of the light guide, with the contact pads suspended over the magnets, which are free to move in the pockets, and the LED's light output is directed into the light guide.

Figure 3:
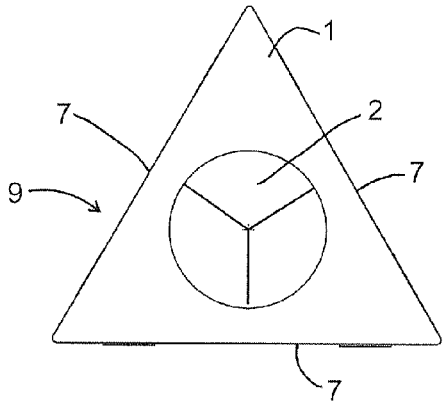
FIG. 3 is a top view of the planar lighting module of FIG. 1.
Figure 4:
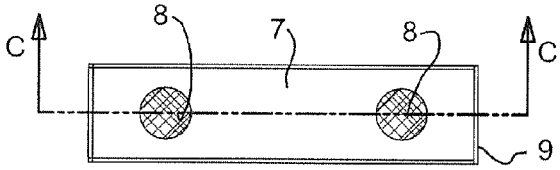
FIG. 4 is a side view of the planar lighting module of FIG. 1 and has an orientation that corresponds with that of FIG. 3.
Figure 5:
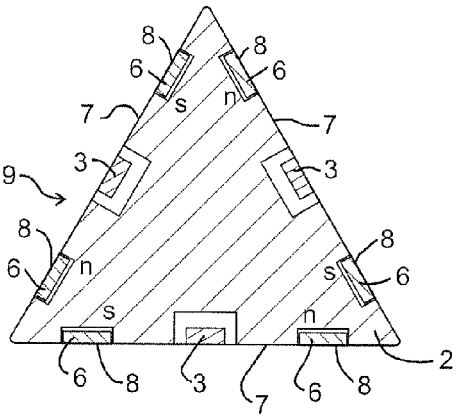
FIG. 5 is a cross-sectional view taken along line C-C of FIG. 4.

FIG. 3 shows a top view of module 9. FIG. 4 shows a side view of the module 9 of FIG. 3. FIG. 5 shows a cross-sectional view taken along line C-C in FIG. 4 and illustrates six magnets 6 (with contact pads 8 located on the outer surface of the flexible circuit 7 adjacent to the magnets 6). In the example of this figure, the magnetic are axially magnetized, which means the flat circular faces of each magnet 6 have opposite magnetic polarities. The magnets 6 are positioned within the light guide structure 1, such that the magnetic polarities alternate direction moving around the perimeter of the module. Three LEDs 3 direct light into light guide 1.

In FIG. 5, only the pole of the magnet facing away from the contact surface is shown. It should be understood that the opposite side of each disc (i.e., the side facing the contact) would have the opposite polarity to that shown. (Disc magnets of radial magnetization, cylindrical, spherical or other shaped magnets could also be used as long as they were positioned to provide an attractive magnetic force.)

When two modules are brought into proximity to one another, the N and S poles of magnets 6 of the different modules facing each other are pulled together by mutual magnetic attraction. Simultaneously, the magnets 6 are free to move within the pockets 5, thereby exerting force directly between the mating contact pads 8 of the flexible printed circuit assembly 7 and electrically and mechanically connecting the adjacent modules. The magnets, in effect, pinch the flexible printed circuit contact pads 8 together, providing mechanical and electrical contact between the contact pads and aligning the contact pads and modules. However, there is also sufficient compliance of the flexible circuit and magnetic parts to allow self-adjustments under the magnetic force and a significant amount of flexibility to take up tolerances between adjacent modules. Also, the use of thin flexible printed circuits (for example 0.0005 to 0.003 inch thick polyimide or polyester base material, and approximately 0.0005 to 0.001 inch thick copper), allows the contact pads to change shape by flexing and bending slightly in multiple planes while maintaining reliable electrical continuity between the pads of adjacent modules. This compliancy and movement of a magnetic structure provide some insensitivity to translational or angular misalignment of the electrical interconnection, which is not generally possible with typical pin and blade or pin and socket connectors.

Figure 6:
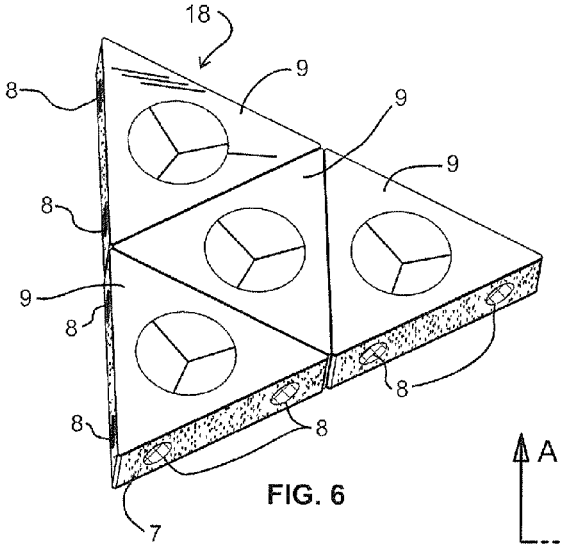
FIG. 6 is a diagrammatic representation of an isometric view of an array of four planar lighting modules.
Figure 7:
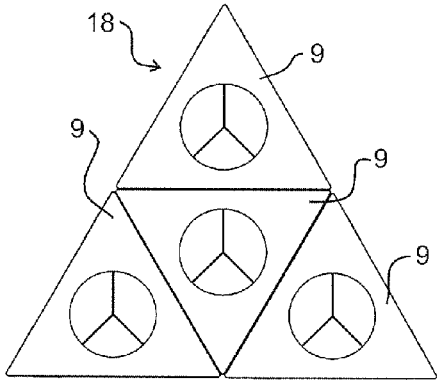
FIG. 7 is a top view of the array of FIG. 6.
Figure 8:
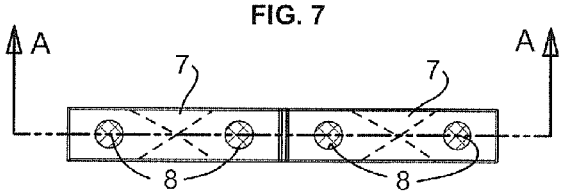
FIG. 8 is a side view of the array of FIG. 6 and has an orientation that corresponds with that of FIG. 7.
Figure 9:
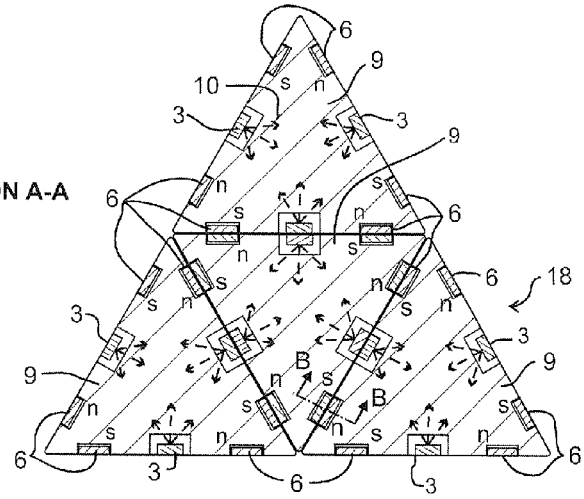
FIG. 9 is a cross-sectional view taken along line A-A of FIG. 8.

FIG. 6 shows an array 18 of four connected modules 9. FIG. 7 shows a top view of the array 18 of FIG. 6. FIG. 8 shows a side view of FIG. 7. FIG. 9 shows a cross-sectional view of the array 18. FIG. 9 shows the mating magnets 6 of adjacent sides of each module 9 mechanically and electrically connected by the opposing magnets and contacts 8 of the flexible printed circuit assemblies 7. Also denoted in FIG. 9 are the example magnetic polarities of the magnets (indicated by "n" and "s"), and the LEDs 3, directing light output 10 into the light guide.

As indicated in FIGS. 6-10, the separation between the light guides in adjacent modules results from the thickness of the flexible circuitry applied to the edge of the light guide. If this circuitry is inset to be flush with the top and bottom edges of the light guides, the light guides between modules may directly touch each other creating an almost continuous lighting system. As in prior art examples, the use of an additional frame piece surrounding the light guide is not necessary, as is the extension of an electrical pin, tongue, tab, or overlap of one module into the socket of an adjacent module. Accordingly, lighting modules in this system can be assembled with tiles approaching each other in any direction that provides a clear path to place contacts of one module next to contacts of a second module.

In particular, the central tile shown in FIGS. 6-9 can be removed from the system perpendicular to the system without removing any of the surrounding modules. It should be apparent that this perpendicular removal from an extended planar system using conformable contacts substantially flush with the edges of mating modules is not dependent upon having linear edges. More complicated system geometries, including modules shaped like locking jigsaw puzzle pieces, and modules with compound angled faces could be removed from the middle of a system assembly in an equivalent manner.

Figure 10:
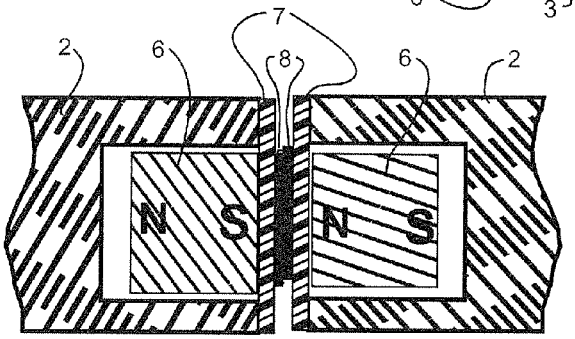
FIG. 10 is a detailed magnified and cross-sectional view taken along line B-B of FIG. 9.

FIG. 10 shows a detailed cross-sectional view (taken along line B-B of FIG. 9) of magnets 6 exerting force on flex circuits 7 and contacts 8 of two modules.

In the above example, since the magnets and hence magnetic poles are constrained in a direction perpendicular to the face of the module (self-aligning magnet embodiments are described later in this document), when connecting adjacent modules, the modules must be oriented such that the polarity of adjacent permanent magnets align N-S poles as shown in the example in FIG. 9. In general, the attractive/repulsive nature of the magnetic pole orientation may be used to restrict the possible mating of certain modules through the choice of how the magnets and their poles are oriented in these modules. Maintaining the desired orientation of the poles may be done through restrictions in the clearances of the pocket cavity relative to the magnet. A desired orientation could also be maintained even with spherical magnets by attaching the magnet to the rear side of the contact with adhesive. In this case, movement of the magnet would depend upon the compliancy of the contact and any supporting flexible substrate. Such adhesive attachment of magnets would accentuate the ability to not make an electrical connection to an adjacent contact with the same pole orientation due to repulsive magnetic forces that would tend to pull the compliant contact into the pocket cavity.

The aforementioned is just one example arrangement of magnets, flexible circuits, and contact shapes. Small cylindrical neodymium iron boron magnets with a diameter of 1/16 inch and 1/16 thick are sufficient to generate contact and retention forces between adjacent modules of approximately 80 grams per magnet pair. Spherical magnets of 0.125 inch diameter produce contact forces of 160 grams per pair. If the shape and desired arrangements of modules are pre-determined as few as two contacts per module may be required to physically hold modules together into a system with reliable electrical connections.

Representative planar modules have been constructed and are easily separable and durable for many connect/disconnect cycles, which makes them useful for applications such as entertainment, games or other applications requiring frequent reconfiguration. In addition, the modules may also be removed from an array without the need for disassembly of multiple array parts. This is not generally possible with conventional connectors that require restricted mating orientations. This is possible in some embodiments disclosed herein, since the entire contact system in one or more modules may be essentially flush or slightly recessed until assembled.

For example, the array of modules in FIG. 7 may be assembled by bringing the modules together by moving them in the plane of the figure. However, even the central module may be removed perpendicular to the plane of the assembly without removing the surrounding modules. If non-planar elements are built into the contact surfaces, then it may be slightly more difficult to remove the central module. These non-planar elements may be used to influence the mechanical alignment of the modules to restrict electrical connection orientation, provide more mechanical stability, or create contact wiping during assembly. Even so, removing the central module will require movement of adjacent modules only sufficient to clear any physical interference, rather than complete removal of other modules.

Figure 11:
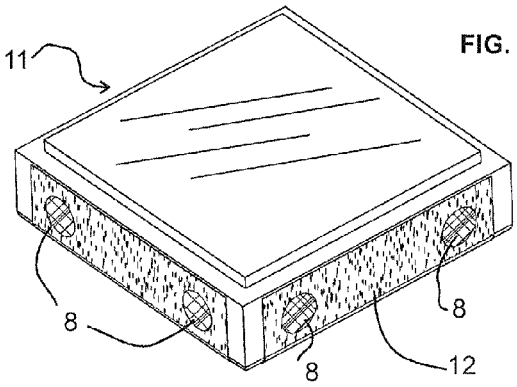
FIG. 11 is a diagrammatic representation of an isometric view of an electronic module, which is used to describe an exemplary embodiment of the present invention.
Figure 12:
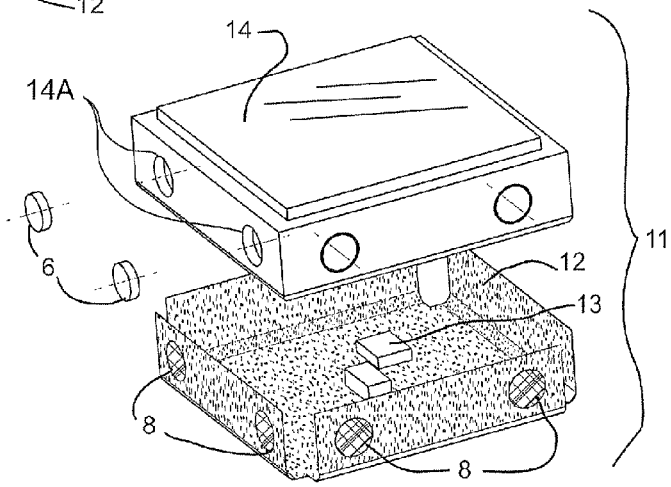
FIG. 12 is an exploded view of the electronic module of FIG. 11.

The illustrative discussion of the planar module above had the flexible circuitry and associated electronic components wrapped around the perimeter of the module in one direction. However, the circuitry including compliant contacts and/or electronic components may also extend to additional surfaces of the module. FIGS. 11 and 12 show an example of a generic electronic module 11 with a square configuration, comprised of a frame 14 having magnet retaining features 14A and magnets 6, onto which a flexible circuit assembly 12 is applied with adhesive or other attachment methods. The flexible circuit assembly includes contacts 8 and electronic circuitry to power and control components 13 located within the module. The interconnection method in this example may be the same as described previously for the triangular lighting modules 9.

As in the previous discussion, the frame 14 may be a transparent light guide structure. (Throughout this disclosure, "transparent" is meant to include any material that transmits some light at a desired wavelength whether it absorbs or scatters any part of the spectrum.) The frame 14 may also be made of an opaque material that does not transmit light at a desired wavelength. For a lighting module, opaque (i.e., non-transparent) material would have to be removed between the light source and the viewing direction. The frame in this case may comprise a hollow box or peripheral frame to support the flexible circuitry, compliant contacts, magnets and electronic components. The frames may be fabricated from materials or using processes that provide additional functionality or manufacturing advantages. For example, frame 14 may be constructed of molded polymers or non-magnetic materials such as aluminum, copper or magnesium. The frame 14 may be used for heat-sinking and heat-dissipation of higher powered components (such as densely packed or high powered LEDs). The flexible printed circuit 12 can provide very efficient thermal conduction to the frame 14 through the use of copper planes and thermal vias and thermally conductive adhesives, common to the flexible circuit industry. Although not shown, the contact pads, LEDs and/or other electrical elements could also be located on the smaller edges of this module. Recesses in frame 14 may be desirable in this case. It should also be apparent that additional optical or electrical elements, including for example, reflectors or diffusers, could be incorporated into the lighting module to affect the characteristics of the light or to provide additional electronic control. Although the flexible circuit assembly is shown covering all but one face of the electronic module, there is no limitation in this disclosure on how many surfaces or to what extent any surface includes a portion of the flexibly circuit assembly.

Figure 13:
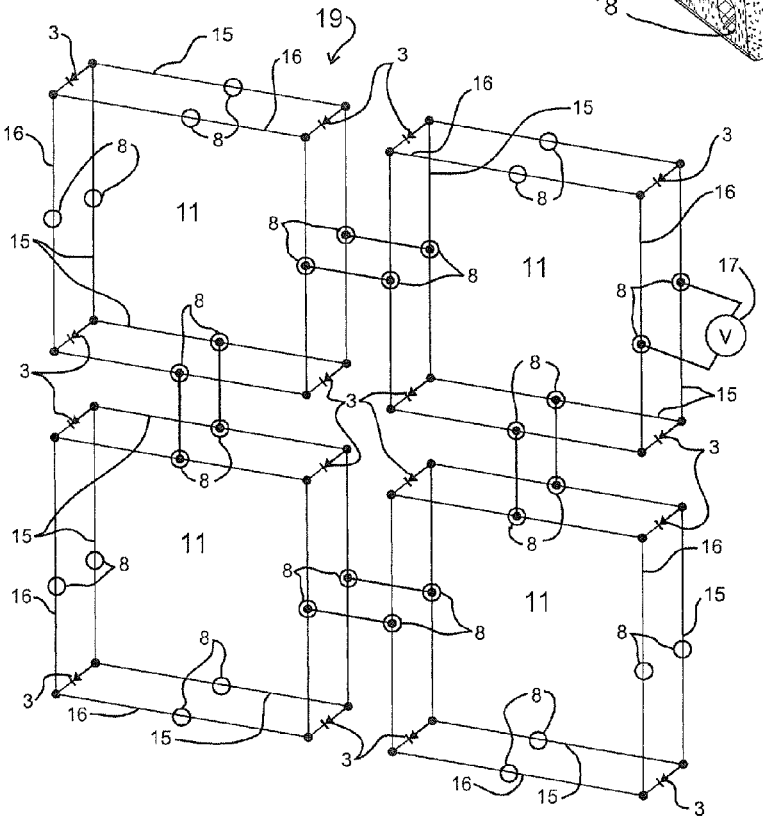
FIG. 13 is a schematic representation illustrating exemplary electrical connections in an array of electronic modules that are similar to the electronic module shown in FIG. 11.

FIG. 13 shows a schematic representation of how multiple modules 11 of FIG. 11 may be connected in an array 19 that is electrically connected in parallel from module to module, with power being supplied to a single module in an array from a power source 17. Circuitry elements 15 and 16 fabricated on the flexible printed circuit are connected to two terminals (for example, positive and negative in the case of direct current applications) of power source 17, through the contacts 8 (here shown as two discrete contacts per side of a square module), to apply a common voltage across components 3 (e.g. LEDs). Of course, the number, size and shape of contacts, shape of modules and the electrical interconnection may be of an almost endless number of configurations. For LEDs, the wiring may result in series or parallel arrangements of devices, and may employ both DC and AC drive voltages as is known in the art.

Figure 14:
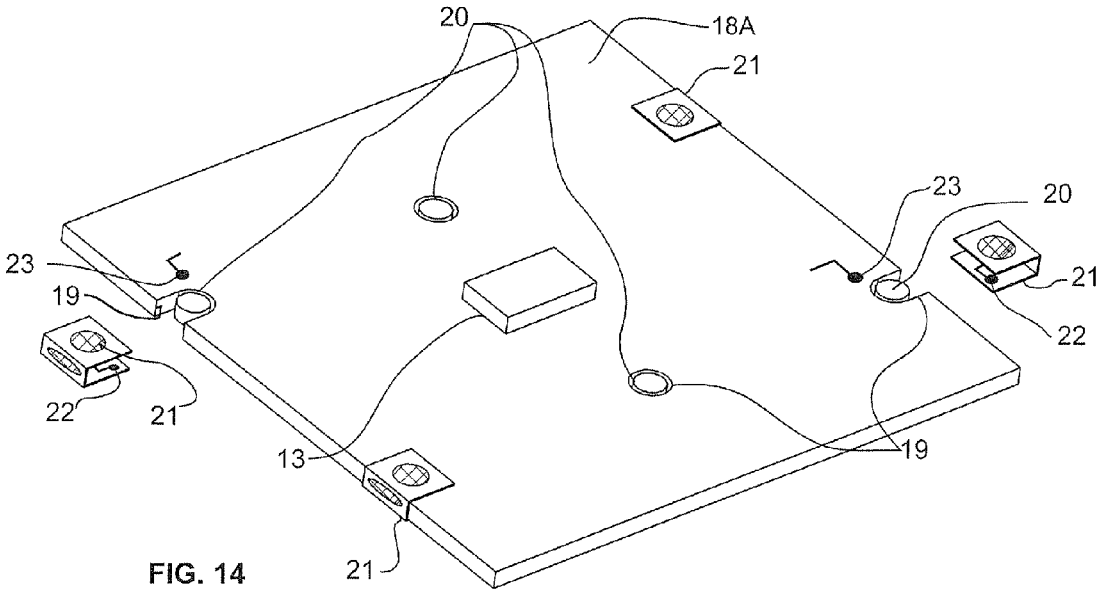
FIG. 14 is a diagrammatic representation of a top isometric view of an electronic module that is partially disassembled, which is used to describe an exemplary embodiment of the present invention.
Figure 15:
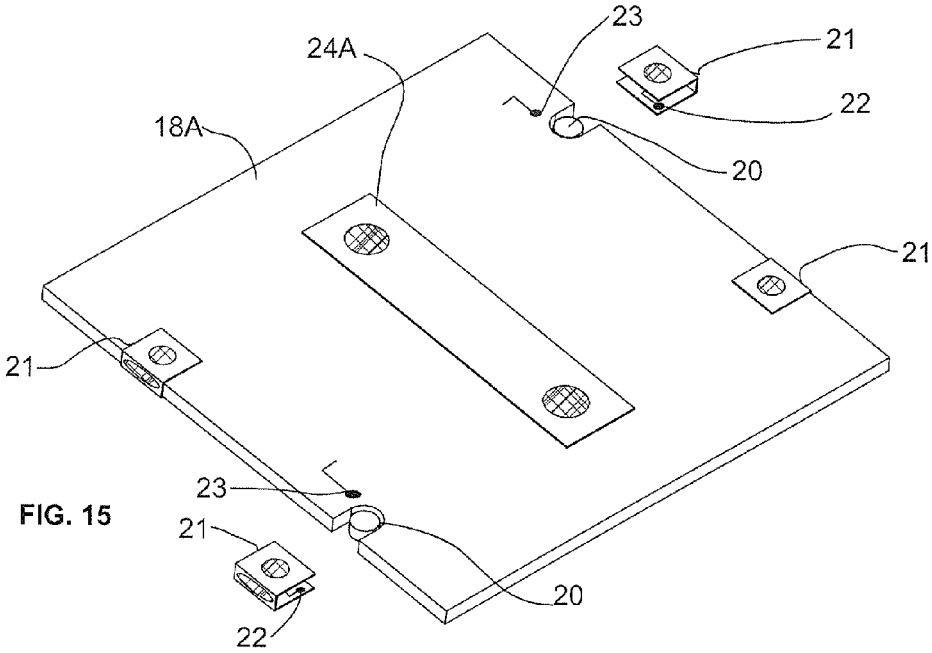
FIG. 15 is a bottom isometric view of the electronic module shown in FIG. 14.

FIGS. 14 and 15 illustrate another method of constructing a flexible magnetic interconnected module. Rather than a separate frame and flexible printed circuit, modules may be constructed with the conformable flexible contacts supported by adjacent conventional rigid printed circuit boards, rigid-flex circuit boards, ceramic substrates or molded interconnect devices ("MIDs"). The substrate 18A may include a variety of circuitry, devices 24 and lighting components such as LEDs. A variety of construction methods are possible.

One example construction method may comprise a separate electronic substrate (PCB, rigid-flex, ceramic, MID) 18A with pockets 19 that contain magnets 20 and/or ferromagnetic actuators. These recesses may be located anywhere on the substrate, e.g. along edges, extending between opposite faces away from the edges, and may also be blind holes which do not extend through the thickness. Ferromagnetic actuators and/or magnetic actuators 20 may be placed within these recesses. Compliant contacts 21 cover the recesses to retain the actuators, that is, the magnetic structures.

These compliant contacts may comprise flexible printed circuitry which includes electrical interconnection pads 22 that may be connected to mating substrate pads 23 of the electronic substrate during assembly by soldering, conductive adhesives, anisotropic electrical adhesives, mechanical clamps or other electronic assembly processes. These compliant contacts may also include metallic foils or wires that do not have insulating substrates or patterns but may also be electrically connected to the electronic substrate.

Flexible contacts 21 may be wrapped around edges and/or applied to faces as discrete pieces 24A to specific areas on one or more extended surfaces of the substrate 18A. Whether wrapped around an edge or attached to one side of the substrate, the flexible contacts may extend beyond the vicinity of a single contact. Multiple connection orientations are possible to allow stacking interconnects, adjacent interconnects, and angular or articulated interconnects. As mentioned previously, flexible contacts 21 may also be comprised of metal foils or other conductive films.

Another example fabrication method may include integral fabrication of the flexible contacts into the circuit substrate during substrate manufacture. For example, during manufacture of a "rigid-flex" board, common in the PCB industry, flexible layers are incorporated into the electronic substrate during manufacturing. These included flexible circuit layers may form the flexible conformable contacts without the need for a separate application process. Tabs may be left projecting from the edges of rigid-flex boards to "fold" over to entrap the magnetic structures or actuators, or a separate mechanical part may be added to retain the magnetic structures. It is also possible to completely entrap the magnetic actuators during the circuit fabrication and lamination process.

Alignment of magnet poles is generally not a concern when the contact pair consists of a magnet and a magnetic material. In some applications it may be desirable to have magnets in each module of a mating contact pair, but not to restrict the orientation of the poles of the magnets. An embodiment of the magnetic flexible interconnection of modules includes magnets that are self-aligning during the assembly of modules into a system. This self-aligning feature eliminates the need to orient the N-S poles of magnets during assembly of individual modules in each contact pair and during assembly of the modules into system arrays. The self-aligning approach also allows modules to be electrically and mechanically joined in multiple orientations and angles without the need to orient the poles of the magnets in the adjacent interconnection. The self-aligning magnets also enable articulated electrical and mechanical interconnections.

Figure 16:
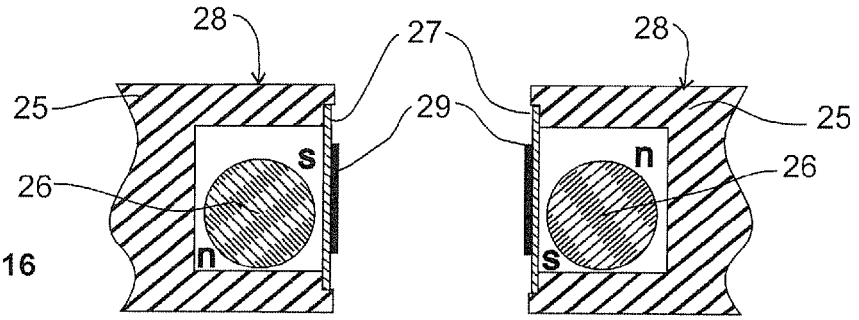
FIG. 16 is a cross-sectional view of a portion of two electronic modules that are not connected with one another.
Figure 17:
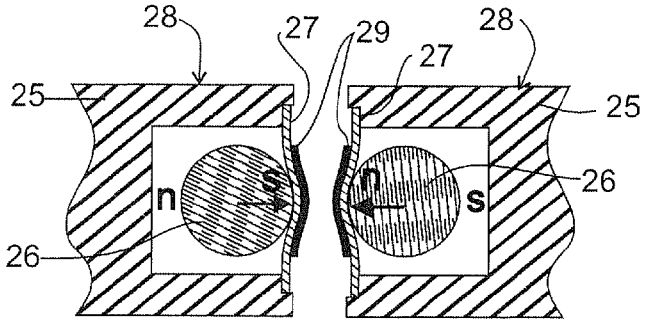
FIG. 17 is a cross-sectional view similar to FIG. 16, wherein the two electronic modules are brought into proximity with one another.
Figure 18:
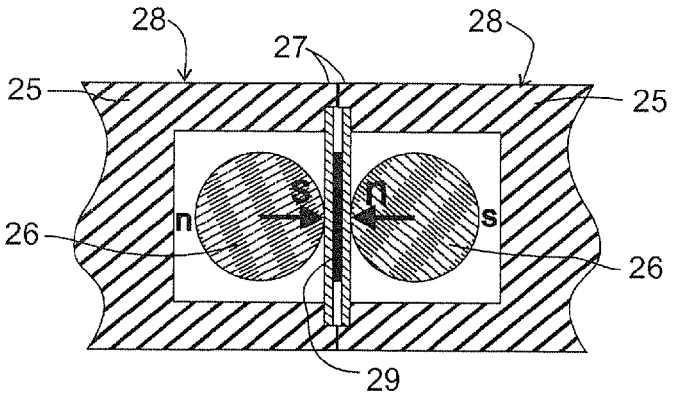
FIG. 18 is a cross-sectional view similar to FIGS. 16 and 17, wherein the two electronic modules are in physical contact with one another.

FIGS. 16-18 illustrate self-aligning magnetic actuators. A frame 25 (or PCB substrate) has a pocket into which magnets 26 are free to rotate. Flexible circuit 27 includes contact pads 29 that are located on the outer surface of the flexible circuit in the area adjacent to the magnetic actuators 26. In this illustrative example, the magnets are spherical or cylindrical in shape, but this is not a requirement for self-aligning applications.

Figure 19:
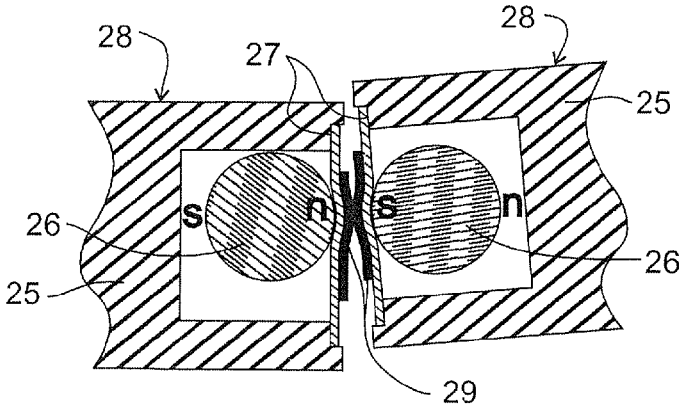
FIG. 19 is a cross-sectional view similar to FIG. 18, wherein the two electronic modules are translated or tilted relative to one another.

When modules 28 are not connected with one another (FIG. 16), the magnets and their north-south poles are randomly oriented in the module pockets. When modules are brought into proximity to one another (FIG. 17), the magnets are free to rotate and translate, allowing magnetic poles to automatically align, and exerting a force onto the flexible, conformable contacts 29. The compliant contacts will conform somewhat to the shape of the magnets on the side facing the other module under the magnetic attraction. The amount of conformity of the contacts will depend upon the thickness and material properties of the metal and any supporting substrate. To modify contact compliancy, the contact pad area and flexible substrate may be patterned or cut, or other variations of materials, thickness and geometry incorporated. The modules are pulled together by magnetic force and the electrical contacts compressed by magnetic force of opposing module's magnets (FIG. 18). This allows significant translation and rotation of mating parts, non-planarity of mating surfaces and low tolerances to be required, since there are no tight mechanical tolerances or elastic properties of the materials required for the contact system to function. The magnets maintain pressure on the contact pads when modules are translated or tilted (FIG. 19). FIGS. 16-19 illustrate schematically how the shape of the flexible circuit may vary as a function of the relative position of two modules. When the modules are separated by a significant distance (FIG. 16), the magnetic force may be too small to change the shape of the flexible circuit. If the flexible contacts abut without any substantial relative displacement (FIG. 18), there may be no magnetic force that results in movement of the magnetic structures to change the shape of the flexible circuit. However, when there is a small separation between the flexible circuits (FIG. 17), or a misalignment (FIG. 19) between flexible circuits, there will be a change in the shape of the flexible circuit. These changes in shape may be only temporary due to changes in position of the modules during assembly or due to vibration or other movement after assembly.

The flexible printed circuit has the ability to flex and distort somewhat providing the ability to accommodate tolerances and various amounts of non-planarity. As mentioned above, the compliant contacts will conform somewhat to the shapes of the magnets and the maximum contact force will exist where the magnets are closest to each other and compressing the compliant contacts together. Cylindrical or spherical magnet shapes that compress the flexible printed circuit contacts benefit from higher Hertz stress for electrical contact. The Hertz stress will also be higher with any contact between a contact with curvature and a flat contact, as opposed to two flat contacts.

The self-aligning magnets need not be limited to cylindrical or spherical shapes. Any simple shape or complex three-dimensional construction that allows the magnets to orient and rotate may be designed to be self-orienting. For example, a "dumbbell" shaped magnet, radially magnetized, may be oriented vertically, horizontally or at angles to make connection to one or more contact pads. The movable magnets (or ferromagnetic structures described below) may be captured in the recesses by flexible circuitry and/or retained by mechanical means that do not interfere with the electrical connection.

Referring to FIGS. 20-24, another example module 30 with self-aligning magnets is shown, and the illustrated configuration provides an articulated modular system that acts similar to a hinge. In this example, magnet pockets 31 are enlarged into slot-like configurations accessible to multiple faces of the module and frame, and the contacts 32 of the flexible printed circuit 33 are extended likewise to additional faces/surfaces.

Similar to prior embodiments, a non-magnetic frame or printed circuit substrate 34 is provided with pockets 31 to contain magnets 35. Self-aligning magnets 35 in this example are cylindrical magnets, magnetized radially (across the end face direction). The north pole orientation is shown schematically as arrows marked with an "n" in the figures. The magnets are free to rotate in pockets 31, and thus are randomly loosely positioned in pockets 31 when the modules are not electrically or mechanically connected to one another.

A printed circuit assembly 33 having contacts 32, circuitry and components 36 is affixed to the frame 34. The frame 34 may be a light guide structure and the electronic components may include light sources to create a lighting module. The flexible printed circuit board may be of a different size or shape than illustrated.

Figure 20:
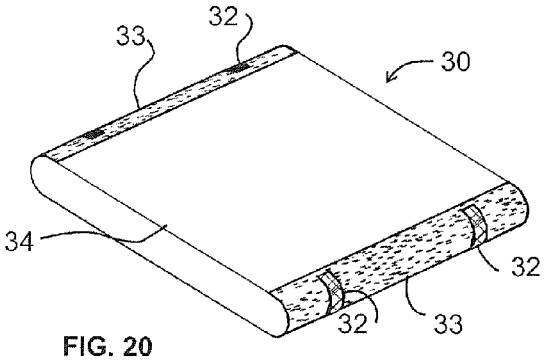
FIG. 20 is a diagrammatic representation of an isometric view of an electronic module, which is used to describe an exemplary embodiment of the present invention.
Figure 21:
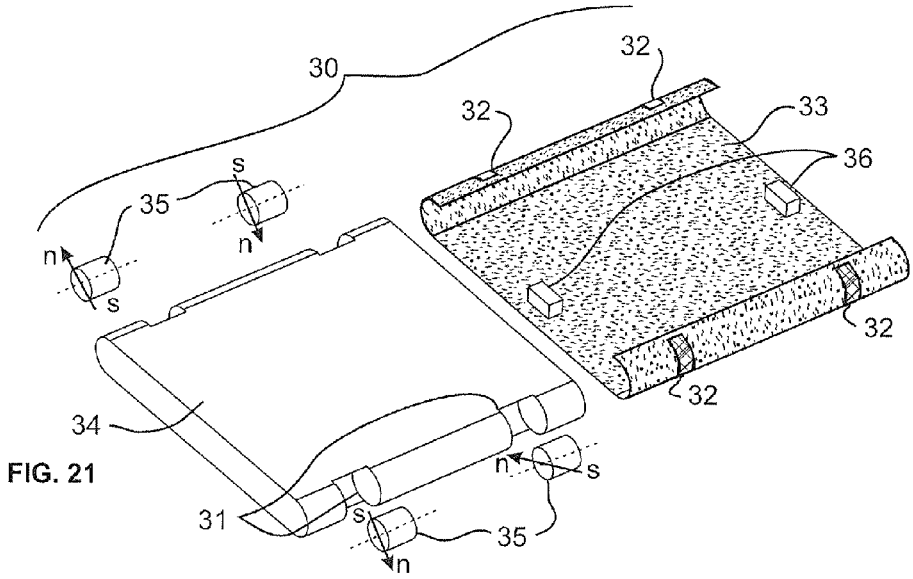
FIG. 21 is an exploded isometric view of the electronic module of FIG. 20.

FIG. 20 shows the assembled module having two opposite sides, each having a semi-cylindrical shape including contacts 32. When two modules are brought into proximity to each other along the edges with the contacts, the magnets rotate to align the N-S magnetic poles, pull the modules together, and exert contact force between the adjacent electrical contact pads 32 on the flexible printed circuits of each module. FIG. 21 shows an exploded isometric view of the module 30.

Figure 22:
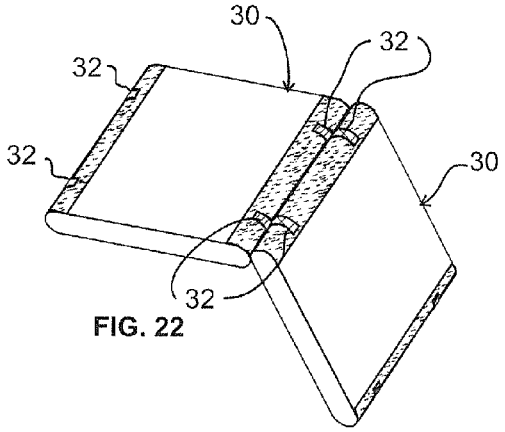
FIG. 22 is an isometric view of two electronic modules that are electrically and mechanically connected.
Figure 23:
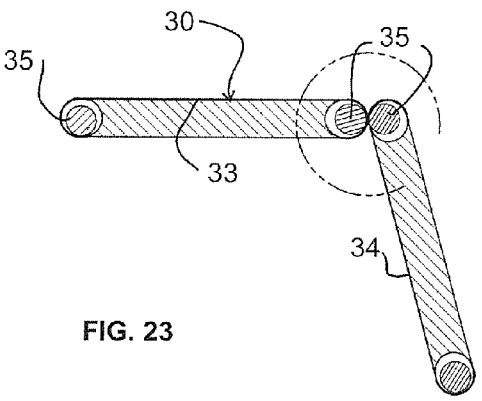
FIG. 23 is a side-sectional view of two electrically and mechanically connected electronic modules.
Figure 24:
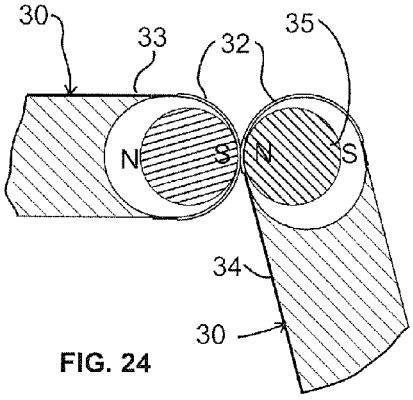
FIG. 24 is a magnified cross-sectional view of a portion of FIG. 23.

FIG. 22 shows an isometric view of two modules 30 electrically and mechanically connected together. FIG. 23 shows a side sectional view of two magnetically interconnected modules 30. FIG. 24 is a magnified cross-sectional view of a portion of each of the magnetically interconnected modules 30 shown in FIG. 23.

In FIG. 24, the self-aligning magnets 35 automatically rotate by mutual attraction to exert contact force between the contacts 32 of the flexible printed circuit assembly 33. Note that this example configuration also allows articulation of the modules in excess of 180 degrees, while still maintaining electrical connection and mechanical retention. In the absence of any electronic components on the flexible circuitry, the interconnect system above provides a method for creating electrical contacts as part of a separable electrical connector that may have application in portable electronic devices.

It should be obvious that many other edge configurations are possible using the inventive concepts disclosed herein, such as radiuses and facetted edges that allow additional angular configurations to be assembled. The use of flexible printed circuitry allows such curved and facetted edges to be wrapped with contacts located on multiple planes and curved surfaces.

Although the flex circuit is wrapped across the major plane of the module, it may alternatively or in addition be wrapped around the minor plane edges similar to that shown in FIG. 1 or the module shown in FIG. 11 or 15. Electrical components may be located anywhere on the flex circuit. Additionally, three-dimensional molded interconnect device ("MID") substrates may have complicated three-dimensional circuitry with applied compliant contacts and one or more magnetic interconnections as described.

Other variations of the embodiments illustrated include the use of different configurations of permanent magnets in combination with ferromagnetic materials. For example, in FIG. 25, only one magnet 40 in module 36A is used to make the connection to module 41. Module 41 includes a ferromagnetic pad 37, disposed behind the flexible circuit 38 and contact pad 39 of module 41. The magnet 40 is thus attracted to ferromagnetic pad 37 on the second module 41. This magnetic attraction electrically and mechanically connects the two modules. Magnets may be self-orienting, floating or fixed within the frame 42, and are not required to be simple spherical or cylindrical shapes.

Figure 25:
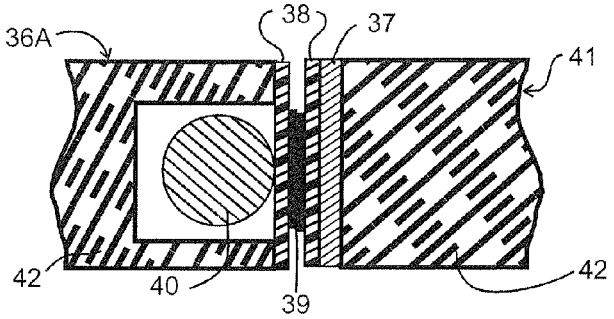
FIG. 25 is a cross-sectional view of a portion of two electronic modules that are connected with one another, wherein one module includes a moveable permanent magnet and the other module includes a fixed ferromagnetic pad.

Although only one electrical contact pair is shown in the previous examples, resulting from one magnetic pair comprising two magnets or one magnet and one ferromagnetic element, it is possible to have multiple electrical contacts result from the magnetic force generated by a single magnetic pair. Additionally, the illustration in FIG. 25 may be replicated to form linear and x-y arrays of contacts. Furthermore, the magnetic actuators may be of a variety of shapes. Although permanent magnets may be formed in different shapes, stamping and other standard metal forming operations of ferromagnetic or other magnetic materials may provide cost or design advantages. A single ferromagnetic element may be shaped to provide desired contact geometry with a plurality of individual magnets in an adjacent module. As noted in general previously, the magnet and ferromagnetic materials may be reversed as compared to what is shown in FIG. 25. That is, actuator 40 may be ferromagnetic and plate 37 may be a permanent magnet.

Figure 26:
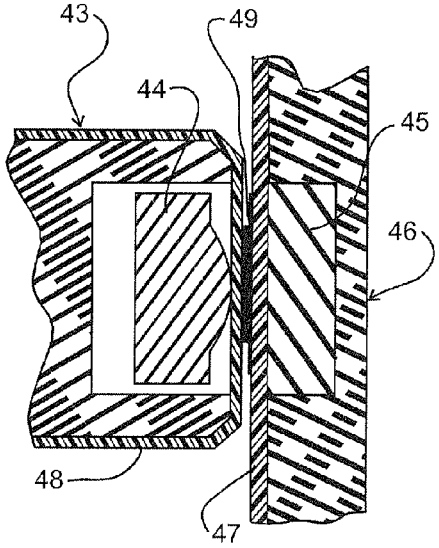
FIG. 26 is a cross-sectional view of a portion of two electronic modules that are connected with one another, wherein one module includes a moveable ferromagnetic element and the other module includes a fixed permanent magnet.

FIG. 26 illustrates another electrical contact construction of an interconnect pair with a first module 43, that includes movable ferromagnetic element 44, which is attracted to permanent magnet 45 included within the second module 46. The second module could also be comprised of a light guide, frame, PCB, rigid-flex board, or MID. Permanent magnets 45 may be fixed or free to move. For example, substrate 46 could be a frame with flexible circuit 47 attached, or a rigid PCB with embedded permanent magnet material and thin (~0.0004-0.01 in. thick) overlay circuit layer.

A plurality of linear or arrayed movable ferromagnetic elements 44 may be used to construct electrical connectors with large numbers of electrical contacts. The shape of the ferromagnetic elements 44 may be tailored to enhance contact stress such as the domed area illustrated. For example, large area arrays with relatively fine pitches between actuators and contacts may be constructed with permanent magnets and cylindrical ferromagnetic actuators.

For example, an array of 0.4 inch long×0.044 inch diameter cylindrical iron actuators with a spacing of 0.123×0.087 inch, placed on top of a 0.062"×1" square thick grade N42 Nd—Fe—B magnet with two layers of 0.003" polyimide flexible circuit material resulted in measured contact forces of 76-81 grams per contact over the entire array of 85 contact pairs. As in previous examples, at least one side of the electrical interconnection includes a compliant flexible circuit element 48, and contacts pads 49 are compressed and retained under magnetic force. In addition to metal contacts that have supporting flexible polymeric substrates, the compliant contact structure could be a locally self-supporting metal structure (such as a wire or foil) that is capable of movement to effect the connection under the pressure of the magnetic force between the magnetically attracted pair.

Figure 27:
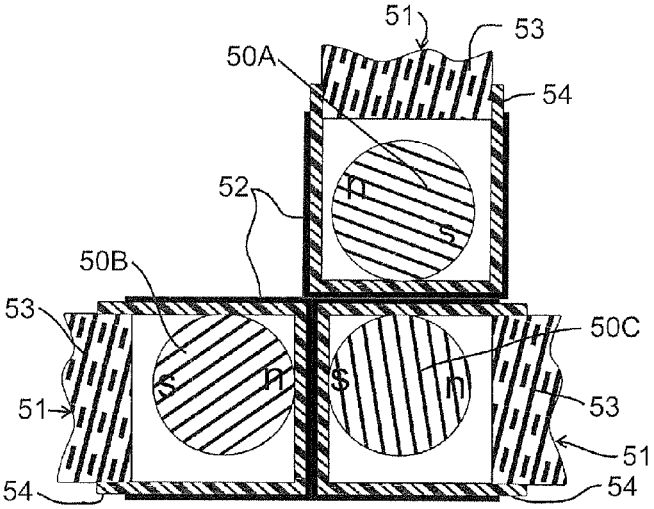
FIG. 27 is a cross-sectional view of a portion of three electronic modules that are electrically connected with one another.

FIG. 27 shows another embodiment of a system of multiple modules 51 each with self-aligning spherical or radially polarized cylindrical magnets 50, flexible circuitry 54, compliant contact pads 52 and light guide or frame 53. As the individual modules are brought together, the self-aligning magnets are free to orient their poles under their mutual magnetic attraction. Note that magnet 50C is simultaneously attracted to both magnet 50A and magnet 50B in the other modules. As a result, magnet 50C simultaneously creates an electrical and mechanical connection to modules in two perpendicular directions. Although the contact metallurgy as illustrated shows a common electrical path between all three modules, it would be possible to have separate circuits connected between modules by having contact circuitry on different faces of the modules that was electrically isolated.

Magnet 50B will also be attracted to magnet 50A, but the attractive force may be less than the attraction to magnet 50C due to the increased distance of separation in the geometry illustrated. With semi-cylindrical contact pads as shown in FIGS. 20-24, three or more modules may be assembled simultaneously about an axis parallel to the magnet axes into a system in which the modules are not oriented at right angles to one another. An alternative embodiment would replace one or more of the magnets in multiple simultaneous contact geometries with ferromagnetic actuators. Since magnetic poles are induced in ferromagnetic materials, ferromagnetic elements magnetically self-align even when they are fixed in position.

Figure 28:
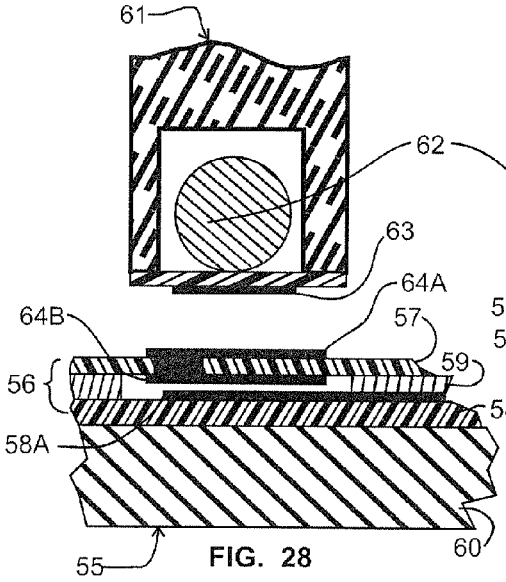
FIG. 28 is a cross-sectional view of a portion of an electronic module and a membrane module assembly that are spaced apart from one another.
Figure 29:
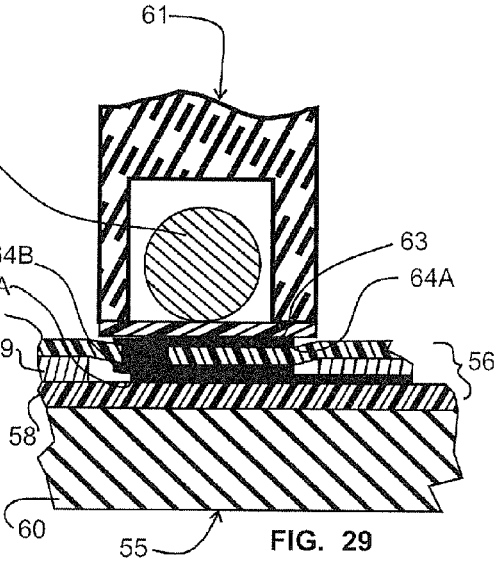
FIG. 29 is a cross-sectional view similar to FIG. 28, wherein a physical and electrical connection is formed between the electronic module and the membrane module assembly.

FIGS. 28 and 29 illustrate an embodiment that allows integral contact switching upon the act of assembling modules. An application of such a design could provide electrical voltage on the contact or to provide other selectable electrical functions only when another module is attached. In this embodiment, at least one of the interconnected modules includes a flexible membrane type contact switch. Unlike the membrane switches generally used in keypads, this membrane has electrical continuity between the inside and outside of the flexible surface at the contact position.

Referring to FIGS. 28 and 29, a membrane module assembly 55 includes a membrane switch assembly 56 comprised of a first circuit layer 57 and second circuit layer 58 separated by an insulating spacer 59, the first circuit layer 57 being flexible, with first circuit layer exterior contacts 64A and first circuit layer interior contacts 64B. Second circuit layer 58 includes second circuit layer interior contacts 58A. In this example the membrane assembly 56 is located above a ferromagnetic base 60, such that when a module 61 is placed onto (or proximate to) the membrane module 55, the permanent magnet 62 is attracted to the ferromagnetic base 60, compressing the first circuit layer 57 membrane switch assembly 56 and simultaneously making electrical contact between first circuit layer exterior contacts 64A and the module contacts 63, and actuating the membrane circuit 56 by deforming first circuit layer 57 such that first circuit layer interior contacts 64B and second circuit layer interior contacts 58A are in contact and compressed by magnetic force between magnet 62 and ferromagnetic base 60.

As shown in FIG. 28, there is no electrical continuity between contact 64B, 64A and 58A, in the absence of module 61. This means that a voltage supplied on second circuit layer 58 and contacts 58A would not appear on exterior contacts 64A until magnetic attraction from attaching module 61 takes place. This electrical isolation may be desirable for safety or other considerations in certain applications. Such contacts may be linear, extended arrays or attached to three-dimensional parts. The integral construction of membrane switches comprising flexible circuits may be accomplished with the same processes that are available to provide membrane switches and keyboard actuators. Note that the membrane contact geometries may also be non-planar and applied to both discrete modules and backplanes.

Figure 30:
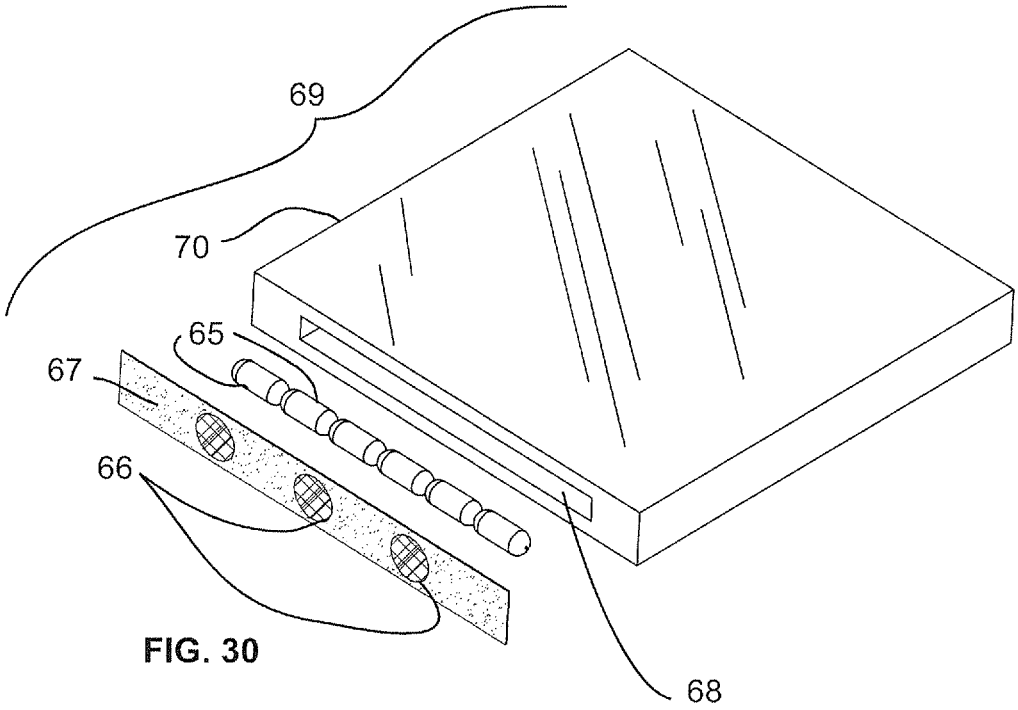
FIG. 30 is a diagrammatic representation of an exploded isometric view of an electronic module with multiple cylindrical magnets, as another exemplary embodiment of the present invention.

FIG. 30 shows another configuration of self-aligning magnets. In this figure, multiple cylindrical magnets 65 with radiused ends that are magnetized radially form a compliant flexible "chain" suitable for applying contact force to multiple contacts 66 or extended linear contacts of flexible printed circuit assembly 67. The magnets fit loosely into a suitable slot 68 in the frame 70 of module 69 and may be retained as described above. Magnets that are not directly behind compliant contacts on the flexible circuitry provide additional mechanical force in holding modules together.

Figure 31:
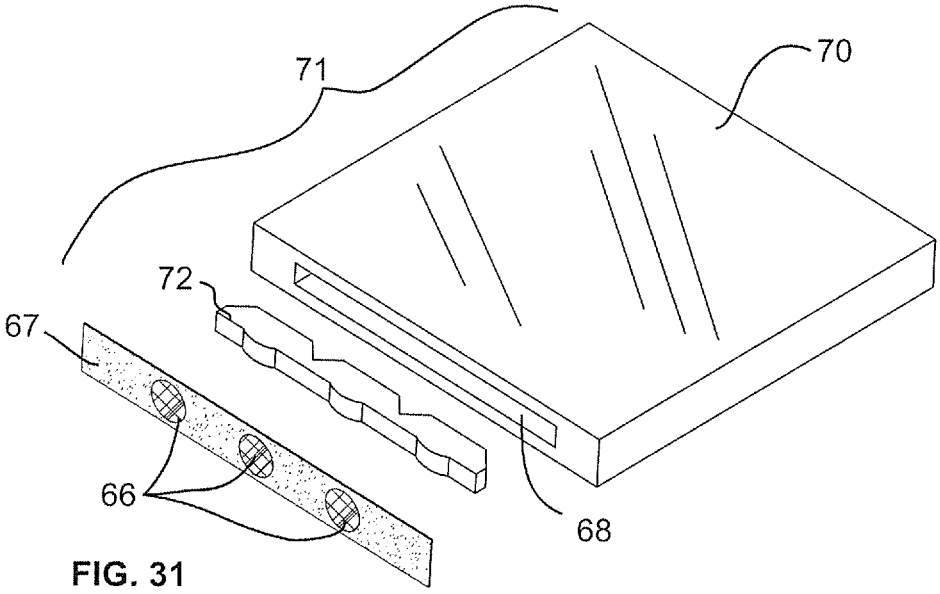
FIG. 31 is a diagrammatic representation of an isometric view of an electronic module with a specially shaped magnet, as another exemplary embodiment of the present invention.

Many other configurations of magnets and contacts are possible consistent with the inventive concept provided. Module 71 of FIG. 31 is similar to FIG. 30, but has a specially shaped magnet 72 having integral contact bumps to tailor contact pad geometry. As shown, other features, such as notches, may be included to allow some additional flexibility in the magnet itself (as with plastic magnet materials), or to retain or limit the movement of the magnet within the cavity 68. Such magnet actuators may be sintered, molded, overmolded, etc. to provide custom shapes.

Figure 32:
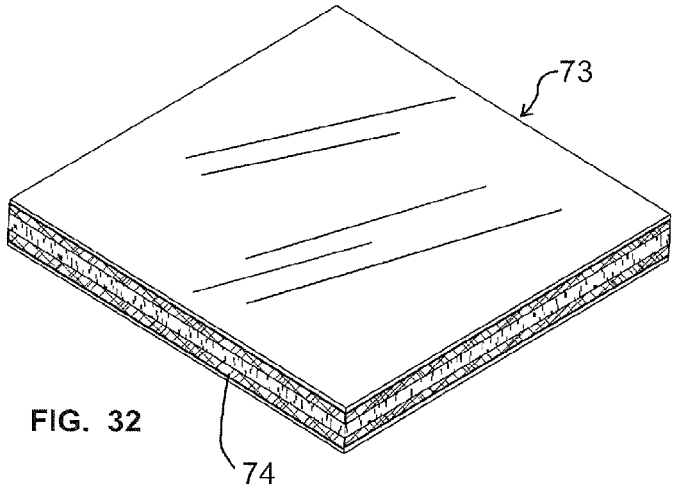
FIG. 32 is a diagrammatic representation of an isometric view of an electronic module with continuous flexible strip contacts, as an exemplary embodiment of the present invention.
Figure 33:
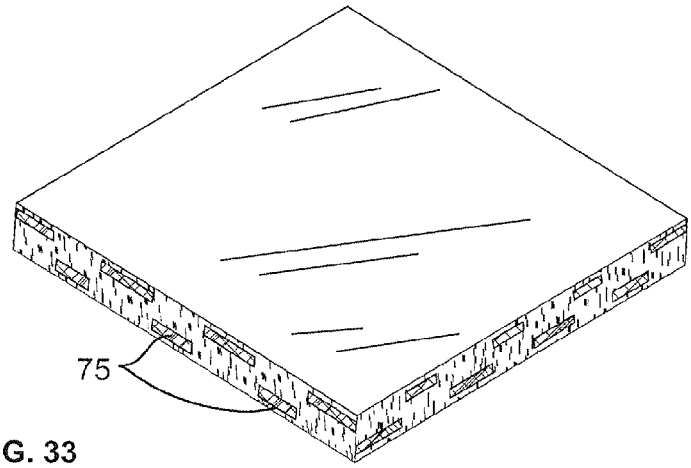
FIG. 33 is a diagrammatic representation of an isometric view of an electronic module with multiple staggered contacts, as an exemplary embodiment of the present invention.

An almost unlimited range of contact shapes, number of contacts and electrical arrangements for interconnecting modules is possible using standard flexible printed circuit board and mechanical process techniques. FIG. 32 shows a module 73 with continuous flexible strip contacts 74. Multiple staggered contacts 75 are shown in FIG. 33. As previously described, contacts may be wrapped onto multiple surfaces of modules. Compound three-dimensional modules 76 may also be constructed as illustrated in the example in FIG. 28 with varied flexible contacts 77 on multiple compound curved faces. Since flexible circuitry patterns can be produced by photolithographic or printing techniques, minimal tooling is required to change the interconnection circuitry of lighting or other modules.

Figure 34:
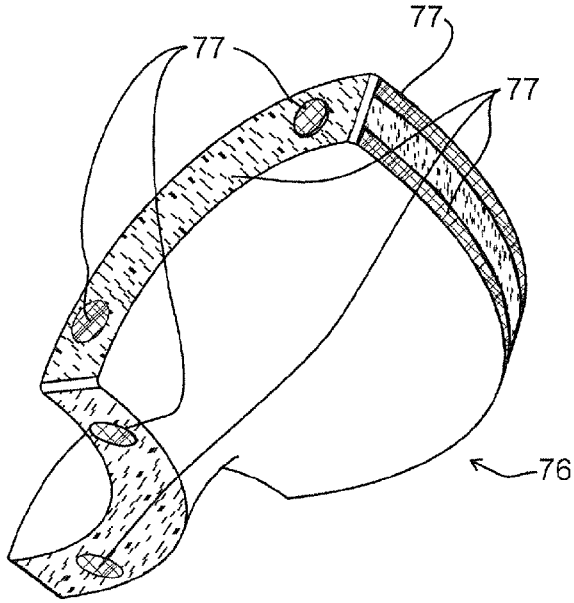
FIG. 34 is a diagrammatic representation of an isometric view of an electronic module that is not a simple planar geometric shape.

Although the descriptions and illustrations above discussed mostly planar and regular geometric shapes, the subject interconnection method is not limited to simple planar geometric shapes. The method also allows assembly of planar shapes with curved sides, tessellated shapes with multiple geometric shapes, compound curved modules as shown in the example of FIG. 34, which may be assembled into different system configurations. The separation of the fabrication of the electronic circuitry including any light sources and contacts from the light guide or frame provides flexibility in module and system design. More than one type of module may be present in an assembled system array. Modules may be of many different sizes. Depending upon the application, the number and size of the permanent magnets can be chosen to provide the mechanical force desired for the electrical contacts and for mechanical stability of systems. Auxiliary mechanical retention and locating features may be easily included.

Figure 35:
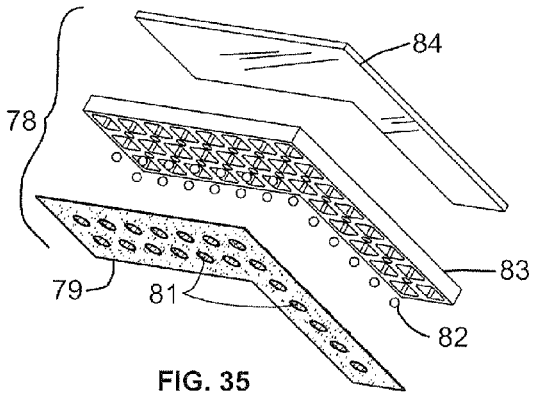
FIG. 35 is a diagrammatic representation of a bottom exploded isometric view of an embodiment of an array module.
Figure 36:
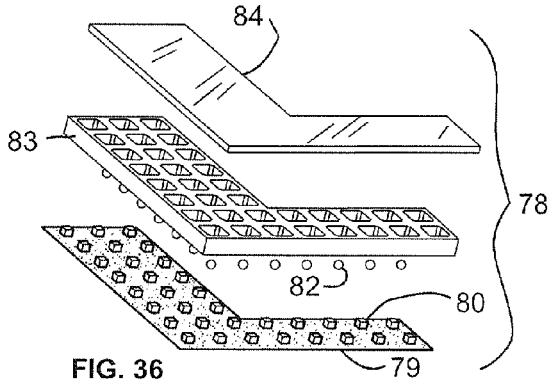
FIG. 36 is a diagrammatic representation of a top exploded isometric view of the array module of FIG. 35.
Figure 37:
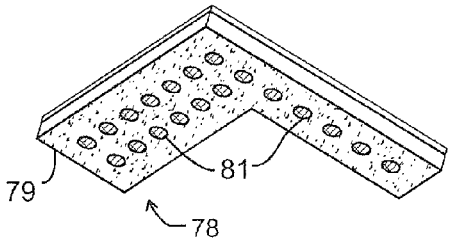
FIG. 37 is a diagrammatic representation of an assembled bottom isometric view of the array module of FIGS. 35 and 36.
Figure 38:
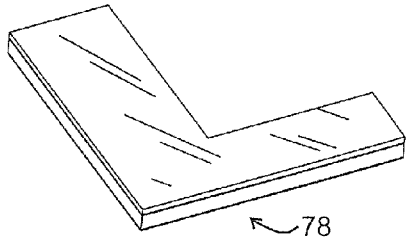
FIG. 38 is a diagrammatic representation of an assembled top isometric view of the array module of FIGS. 35-37.

FIGS. 35-39 illustrate an embodiment which has an area array type of interconnect that may have a membrane that functions like that shown in FIGS. 28 and 29, or as a simple direct contact power/control distribution device to one or more modules. FIG. 35 is a bottom exploded isometric view of an area array module 78. FIG. 37 is an assembled bottom isometric view of an area array module 78. FIG. 36 is a top exploded view. FIG. 38 is an assembled top isometric view. Module 78 is comprised of a flexible circuit element 79 with electronic components 80 and compliant contact pads 81, permanent spherical magnets 82, frame 83, and light guide or cover 84. Note that frame 83 and light guide 84 may be constructed of a single piece of transparent material as shown in previous embodiments. As illustrated, there are 19 contact pads and associated magnets which are arranged in a two-dimensional array.

Figure 39:
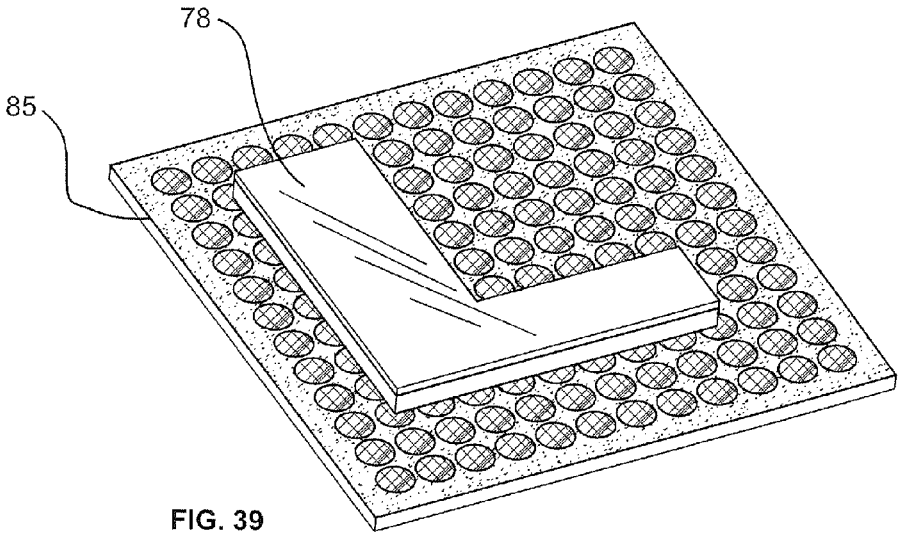
FIG. 39 is a diagrammatic representation of an isometric view of an exemplary array module connected to an exemplary backplane array.

FIG. 39 shows the area array module 78 connected to an exemplary backplane array 85. The array module may be assembled to a membrane switch assembly as previously described, or a non-membrane assembly. In this example, the backplane array 85 may be a flexible circuit attached to a ferromagnetic base, or a printed circuit board with a ferromagnetic base or inserts. The compliancy of the magnetic interconnection system mitigates characteristic problems of prior large area array electrical connections, such as the large compression forces required for mechanical interconnects, fragility of pin and sockets, and coplanarity requirements of typical interconnections. Each of the 19 compliant contacts 81 of the flexible circuitry is mated to a contact pad of the backplane array 85 through the magnetic force provided by one of the 19 magnets. Since the contact force is generated at each of the 19 locations, adding contacts in the array can be done without reducing contact force or contact reliability. Since there is no need to apply an external compressive force or use a resilient member to spread the applied force, the shape of module 78 and the distribution of the contacts are less constrained than in conventional contact arrays. In addition, the light guide or frame can be made of a wider variety of materials including brittle or extremely soft materials (with associated ability to be formed into flexible non-planar shapes) including low-density rubber or polymeric foam without impacting electrical contact reliability. The aforementioned illustration could, for example, be used for lighting or signage, where the emitting components are LEDs or other light sources. Since there is no external mechanical mechanism required to provide the contact force for the array, lighting modules can be located on the backplane array such that the light guides 84 of adjacent modules abut each other.

Figure 40:
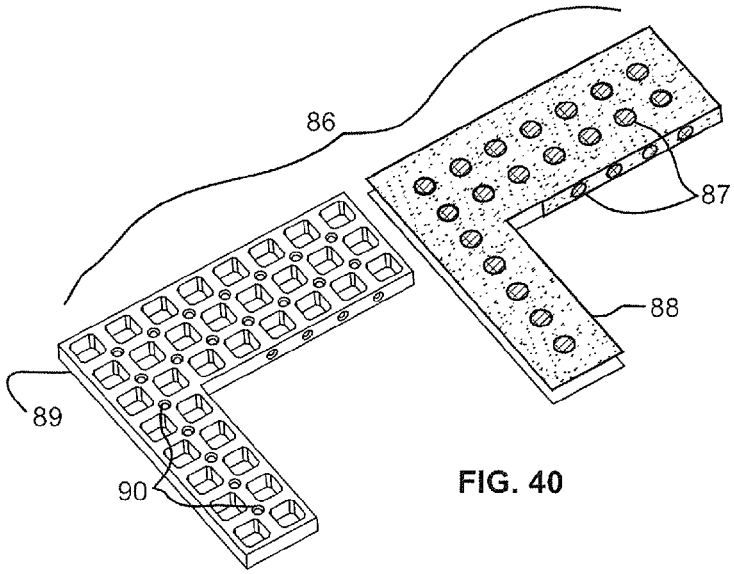
FIG. 40 is a diagrammatic representation of an exploded isometric view of array module with contacts on multiple faces.
Figure 41:
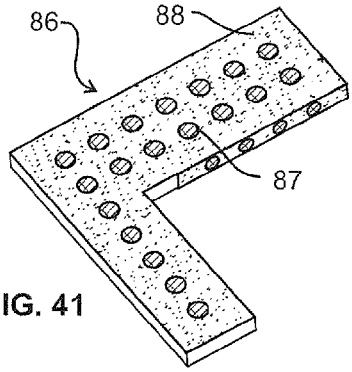
FIG. 41 is a diagrammatic representation of a top isometric view of the array module of FIG. 40.
Figure 42:
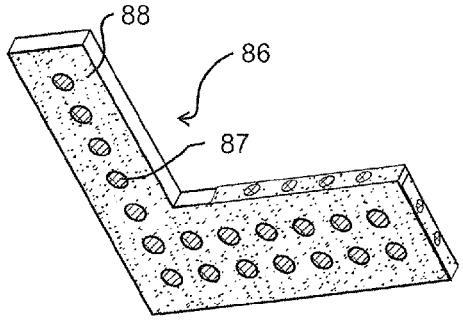
FIG. 42 is a diagrammatic representation of a bottom isometric view of the array module of FIG. 40.

As an extension of this embodiment, FIGS. 40-43 illustrate an area array module 86 with contacts 87 on multiple faces suitable for assembling in a variety of three-dimensional configurations with or without a backplane array. FIG. 40 is an exploded isometric view of the module showing folded flexible circuit 88 in which components could be on the inner (non-visible) faces in the illustration. Magnets 90 are contained loosely in pockets of frame 89. FIG. 41 is a top isometric view and FIG. 42 is a bottom isometric view of the array module with contacts on multiple faces.

Figure 43:
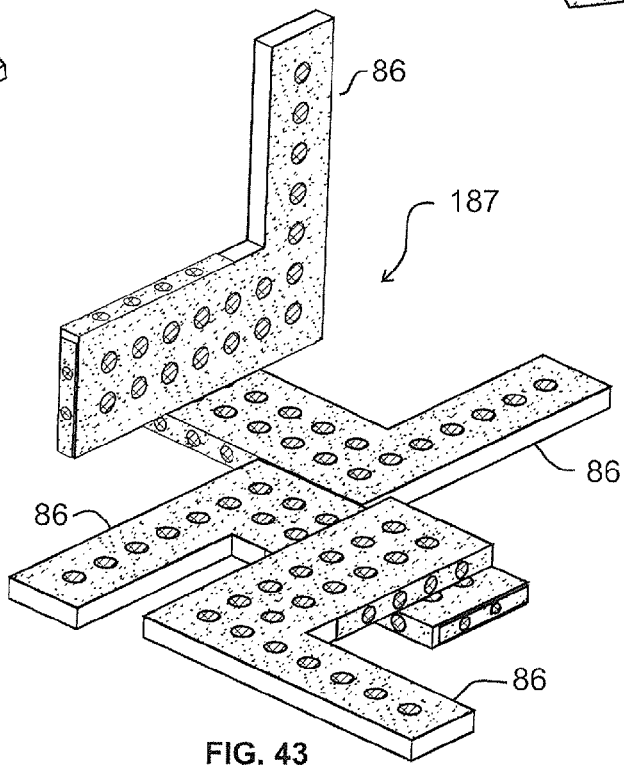
FIG. 43 is a diagrammatic representation of an exemplary three dimensional assembly of array modules.

FIG. 43 illustrates an example three-dimensional assembly 187 of area array modules 86 electrically and mechanically connected through the magnetic interconnections presented earlier. Such three-dimensional interconnections are not limited to any particular shape of modules and could include a combination of self-aligning magnets, fixed magnets and ferromagnetic structures.

Figure 44:
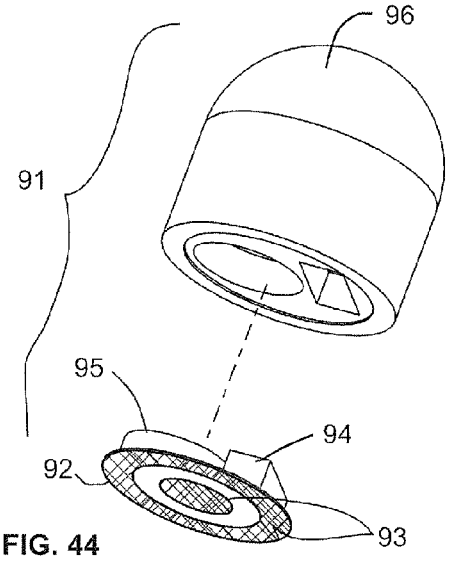
FIG. 44 is a diagrammatic representation of a bottom exploded isometric view of an exemplary electronic module.
Figure 45:
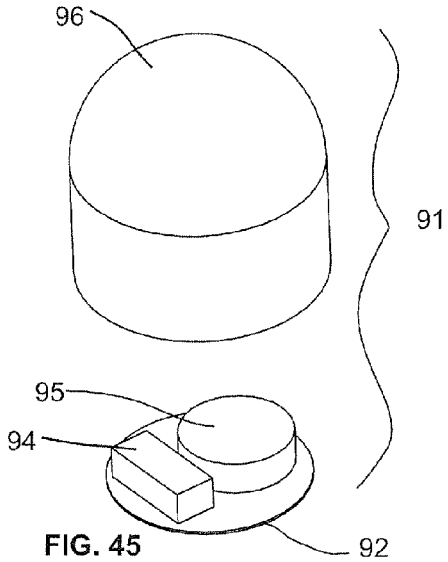
FIG. 45 is a diagrammatic representation of a top exploded isometric view of the electronic module of FIG. 44.

FIGS. 44-47 illustrate a modular magnetic backplane with discretely attachable modules 91. FIG. 44 is a bottom isometric exploded view of the module 91. FIG. 45 is a top exploded isometric view of the module 91 which, in a basic lighting module construction, includes a flexible circuit 92 (with annular contacts 93 on its exterior face), at least one light source 94 (such as an LED and any associated circuitry and electronic components), at least one magnet 95 per module, and a mechanical housing/lens 96. The housing/lens 96 may be molded of transparent polymers as a single piece of any other shape or color and may include other optical structures or elements. In this example, the single magnet 95 spans both the inner and outer annular contacts 93.

Figure 46:
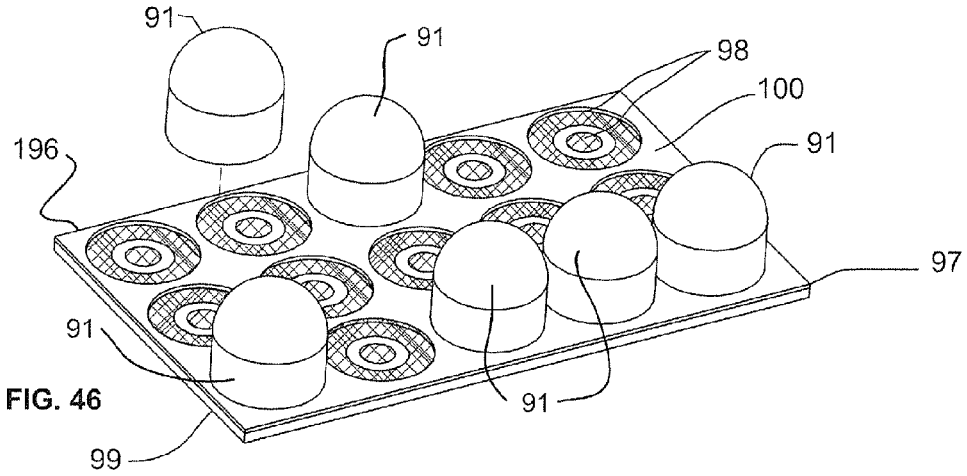
FIG. 46 is a diagrammatic representation of a top isometric view of an exemplary backplane substrate with the electronic modules of FIGS. 44 and 45 connected thereto.
Figure 47:
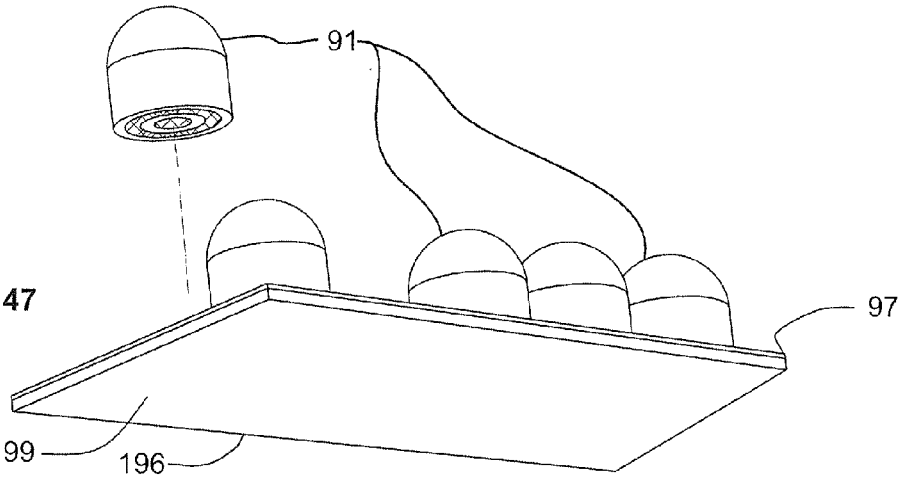
FIG. 47 is a diagrammatic representation of a bottom isometric view of the backplane substrate of FIG. 46 with the electronic modules of FIGS. 44 and 45 connected thereto.

A backplane substrate 196 shown in FIGS. 46 and 47 is constructed from a thin electrical circuit substrate 97 with mating contacts 98 (which are compatible with the annular module contacts 93) attached to a ferromagnetic backing 99. The modules 91 will be attracted and held to the backplane substrate 97 by magnetic force. This magnetic force provides an electrical contact force between the compliant module contacts 93 and substrate contacts 98. Modules 91 attached to the backplane 196 may be provided with electrical power and/or other control functions. The backplane substrate 196 may be constructed in many forms of arrays or predetermined patterns, and may have a locating grid 100 to aid in positioning the modules 91 for attachment, as shown in FIG. 46.

The backplane substrate may also be of a membrane construction as previously described such that the substrate contacts are only electrically connected when a module is assembled to each contact. This example may be constructed on a very small scale (e.g., module diameters of ~0.125 inch diameter could be constructed with single LEDs). As in other examples, it is also possible to switch the permanent magnet and ferromagnetic to either side of the interconnection described. The contact surface of the backplane substrate 196 or magnetic actuator 95 may be embossed or formed into slightly non-planar surfaces to further tailor contact force and Hertzian contact stress.

Figure 48:
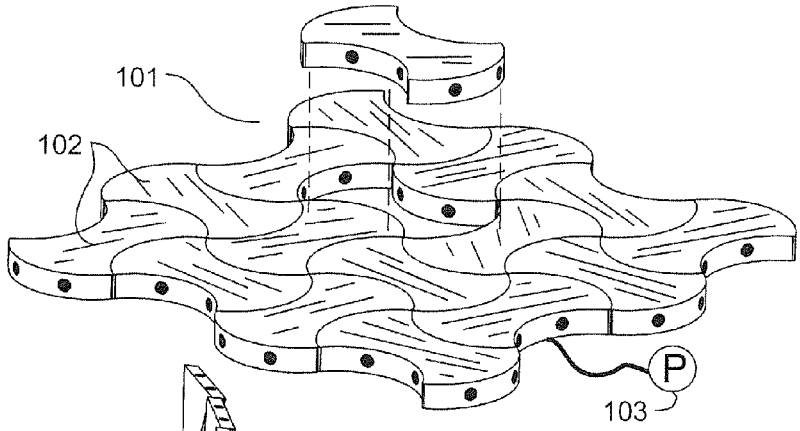
FIG. 48 is a diagrammatic representation of an isometric view of an array of modules with curved sides.

FIG. 48 illustrates an electrically interconnected system array 101 of modules with curved sides 102 of similar construction to the modules in FIGS. 1-9. The flexible circuitry can be easily applied to curved surfaces similar to the linear edges of the earlier examples. With flush edges on these planar modules 102, the ability to easily insert and remove a module vertically from an assembled array is retained regardless of the size of the assembled system array 101. In this example, electrical power 103 is provided to one module through a cable attached to the circuitry of one of the modules 102. The other modules 102 are successively powered when assembled to the array 101.

Figure 49:
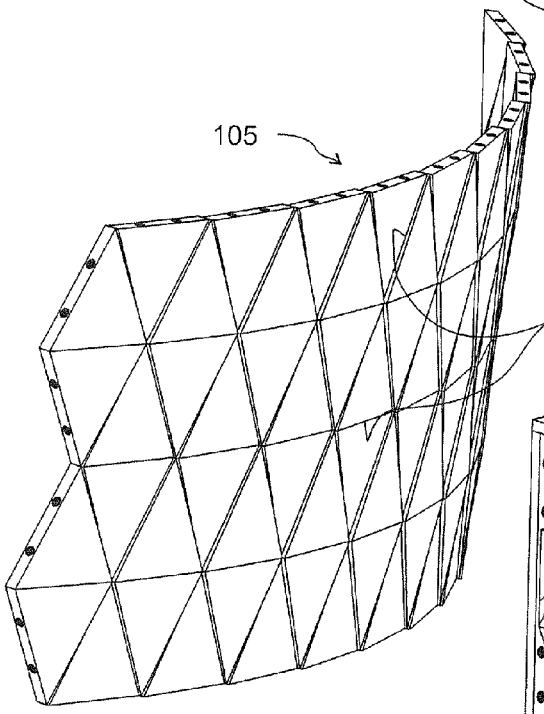
FIG. 49 is a diagrammatic representation of an isometric view of an array of triangular modules forming a curved surface.

FIG. 49 illustrates the flexible magnetic interconnection's ability to conform to compound curved surfaces, illustrated in an interconnected array 105 of equilateral triangular modules 104. Because of the contact deformation inherent in the flexible, conformable contacts, modules 104 with substantially perpendicular and parallel mating faces may be slightly tilted in multiple planes while still maintaining electrical and mechanical connection. Functional prototypes of such triangular modules, with 2 contacts per side, 2.5 inch side length equilateral triangles, 0.210 inch thick have been constructed and tested. Furthermore, they function as described. Angles on the order of five degrees between pairs of modules 104, with each module having perpendicular contact edges with respect to the face of the module 104, have been demonstrated to maintain electrical and mechanical continuity as illustrated.

Figure 50:
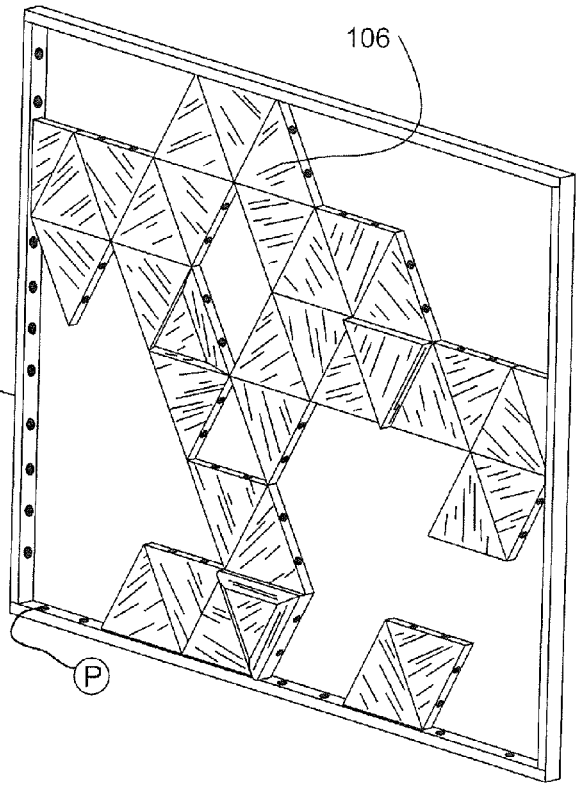
FIG. 50 is a diagrammatic representation of an isometric view of a plurality of light modules that are attached to a ferromagnetic backing sheet.

FIG. 50 illustrates the self-supporting property of the light modules 106. FIG. 50 also illustrates the ability to provide power and electrical connections from one or more edge power strips 107, and also between adjacent tile modules, which allows for many continuous and semi-continuous array constructions and lighting system applications. Additionally, a ferromagnetic backing sheet may retain modules to mechanically hold planar lighting modules in vertical or horizontal planes through magnetic attraction. In this manner, planar lighting tile systems that are readily rearranged can be mounted onto walls or under cabinets with ferromagnetic sheets such as dry erase boards or with magnetic paint including ferromagnetic fillers. Modules may also be attached to cast iron or steel frames, or skins of appliances including refrigerators, tools or other manufacturing equipment.

Although FIG. 50 shows a power frame that completely defines an outer boundary of the assembly, from the illustration in FIG. 48, it should be understood that the power connection need only be applied to a single module 106 for distribution to other modules 106. As a result, systems may be assembled with power applied to any number of tiles in contact with one or more specialized power modules or strips. Multiple electrical paths supplying power in the parallel arrangement shown schematically in FIG. 13 provides redundancy or higher current capability. Modules may also be of mixed shapes and sizes, and power strips may be curved, such as flexible circuitry attached to one or more ferromagnetic substrates is known in the art. Furthermore, one or more modules could also include inductive pickups to eliminate a direct physical connection to the power source.

Figure 51:
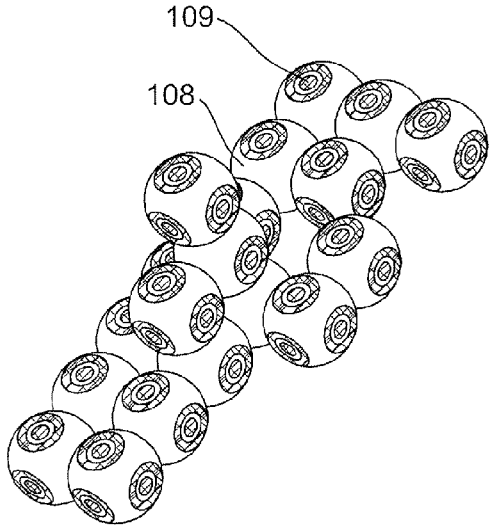
FIG. 51 is a diagrammatic representation of an isometric view of a plurality of spherical modules.

FIG. 51 illustrates a series of stackable substantially spherical lighting modules 108 with annular flexible magnetic contacts 109. The form and functionality of these three-dimensional modules is a straightforward extension of the discussion of modules 91 in FIGS. 44 and 45, except that modules 108 are not attached to the backplane 196 of FIG. 46. In this example, the modules 108 may be connected to one another on multiple faces using the annular contact geometry.

Figure 52:
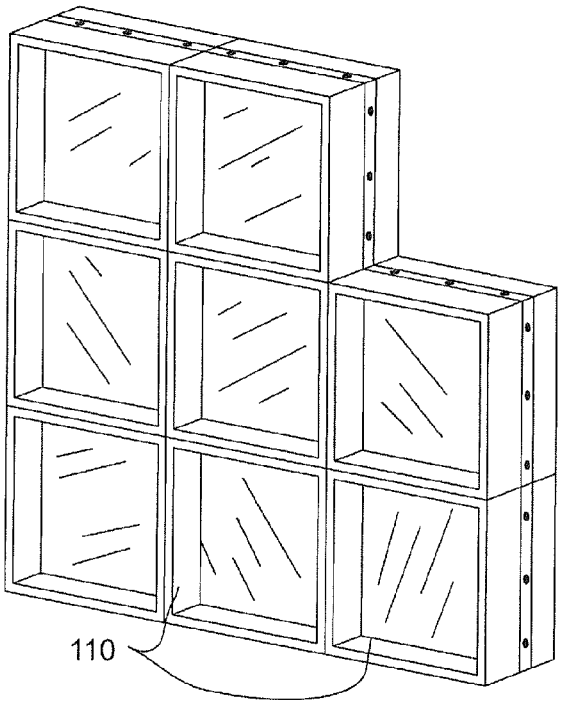
FIG. 52 is a diagrammatic representation of an isometric view of a plurality of modules having flanges and a freestanding block geometry.

FIG. 52 illustrates modules 110 having flanges and a free-standing block geometry. The modules of FIG. 52 are electrically and magnetically interconnected. Other auxiliary mechanical and locating features may be incorporated to reduce the reliance upon the magnetic force from the contacts to hold these modules 110 together, such as pins and sockets, snaps, tongue and grooves, dovetails, etc.

Figure 53:
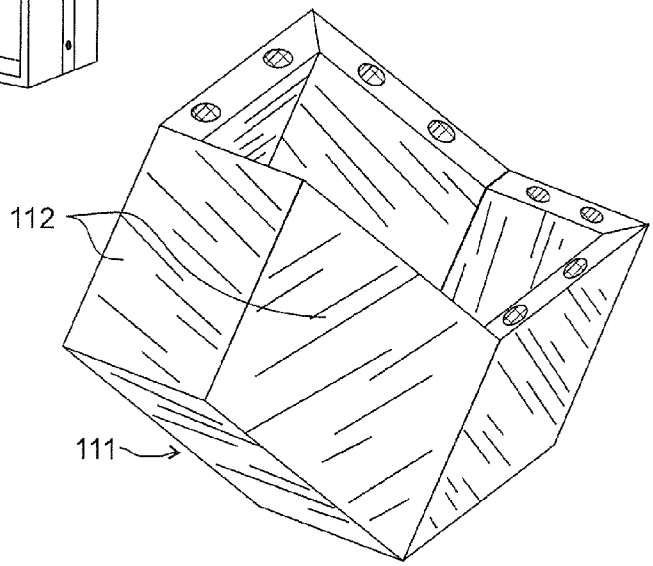
FIG. 53 is a diagrammatic representation of an isometric view of a complex geometric structure formed using electronic modules.

FIG. 53 illustrates the ability to form complex geometric structures 111 with compound sides constructed from a series of flexible magnetic interconnected geometric pieces 112.

Figure 54:
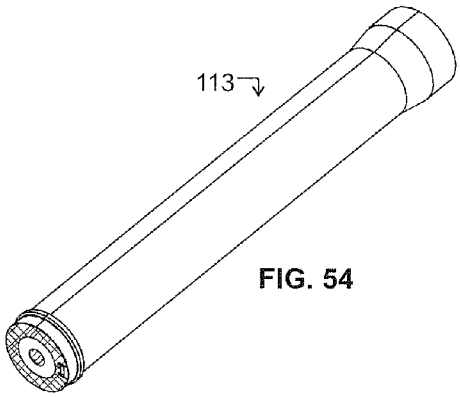
FIG. 54 is a diagrammatic representation of a front isometric view of a tubular lighting module.
Figure 55:
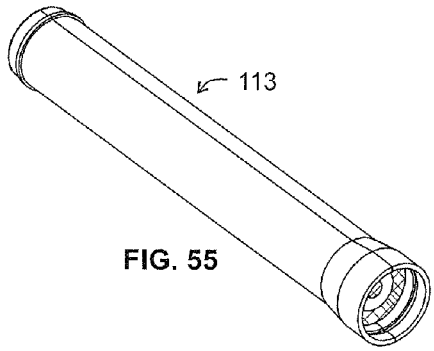
FIG. 55 is a diagrammatic representation of a back isometric view of the tubular lighting module of FIG. 54.
Figure 56:
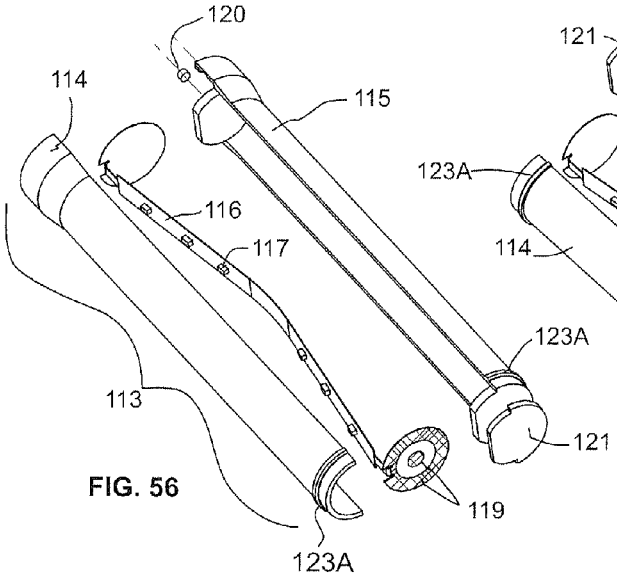
FIG. 56 is a diagrammatic representation of an exploded front isometric view of the tubular lighting module of FIG. 54.
Figure 57:
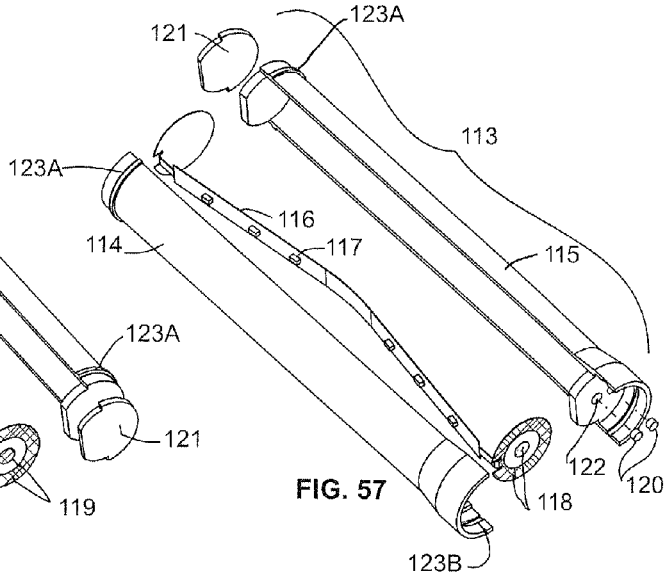
FIG. 57 is a diagrammatic representation of an exploded back isometric view of the tubular lighting module of FIG. 54.

FIGS. 54-58 show tubular lighting modules 113 that may be assembled with one another, or with mating pieces of other shapes. FIG. 54 shows a front isometric view of the tubular lighting module 113, while FIG. 55 shows a back isometric view of the tubular lighting module 113. Similarly, FIG. 56 is an exploded front isometric view of the tubular lighting module 113, while FIG. 57 is an exploded back isometric view.

With reference to FIGS. 56 and 57, the tubular lighting module 113 includes a transparent tubular top housing 114, a bottom housing 115 (typically, an injection molded transparent polymer), a flexible circuit 116 with components and light sources 117, annular top contact pads 118, annular bottom contact pads 119, permanent magnets 120, and a ferromagnetic plate 121. When assembled, the ferromagnetic plate 121 is located on the end of (or proximate to the end of) the housing 115 that is opposite to the end with the magnets 120.

Flex circuit contact pads 119 are located on the outer surface over the ferromagnetic plate 121. Magnets 120 are located loosely in cavities 122 with flexible circuit annular contact pads 118 disposed over and entrapping magnets 120.

A mechanical retention feature 123A and 123B (in this example illustrated as a separable integrally molded raised rib 123A and mating groove 123B) may be incorporated to further locate and retain tubular modules when interconnected. This mechanical retention feature only need roughly locate and retain the tubular modules, since the compliant contacts and magnetic interconnection provide an actual electrical connection. In other words, unlike conventional contact systems, the housings are not required to generate or overcome spring-loaded mechanical forces to provide electrical contact forces.

Figure 58:
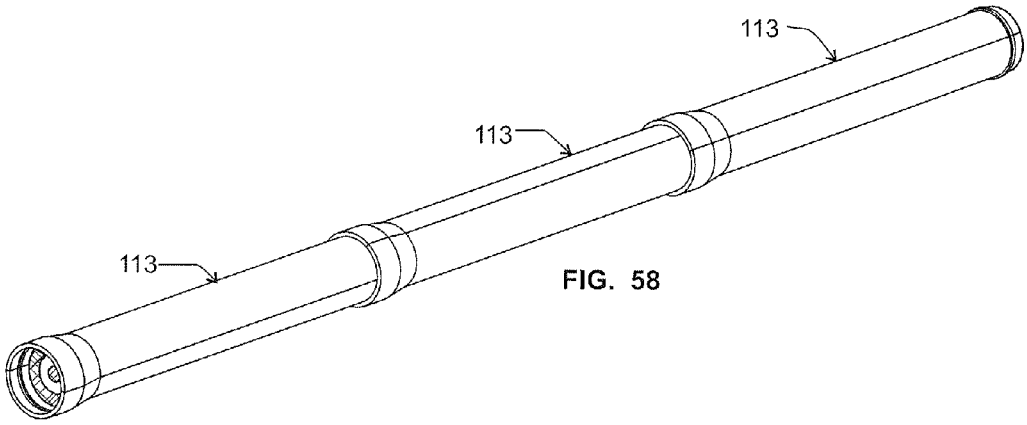
FIG. 58 is a diagrammatic representation of an isometric view of three tubular lighting modules that are interconnected.

FIG. 58 shows three tubular lighted modules 113 that are interconnected. The annular contact geometry requires no particular orientation of each module along the long axis of the assembly to electrically connect the modules.

It should be noted that ferromagnetic plate 121 may also be a permanent magnet and magnetic actuators 120 may be ferromagnetic parts. One or more actuators may be present in such assemblies. The flexible circuit is required only over the actuators, and other portions of circuitry may be rigid printed circuit boards, or other electronic substrates or parts.

Figure 59:
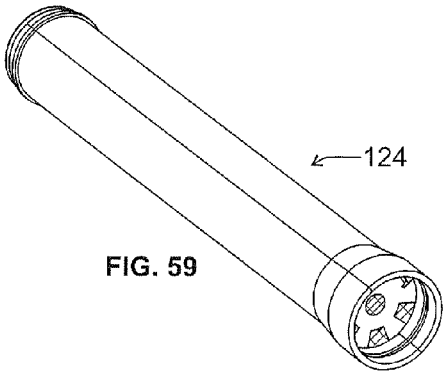
FIG. 59 is a diagrammatic representation of a front isometric view of a selective switching module.
Figure 60:
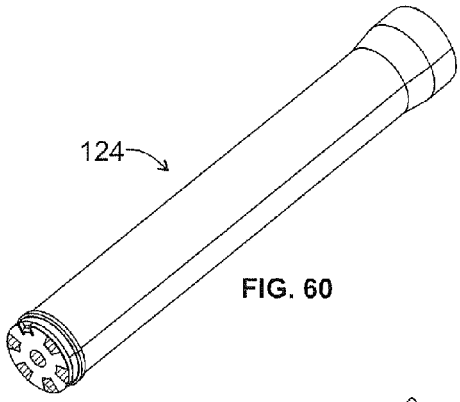
FIG. 60 is a diagrammatic representation of a back isometric view of the selective switching module of FIG. 59.
Figure 61:
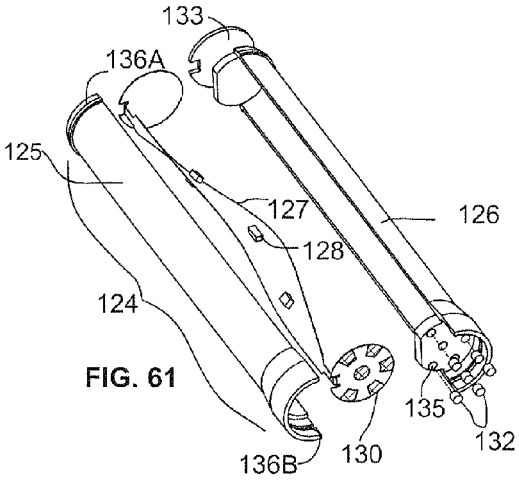
FIG. 61 is a diagrammatic representation of an exploded front isometric view of the selective switching module of FIG. 59.
Figure 62:
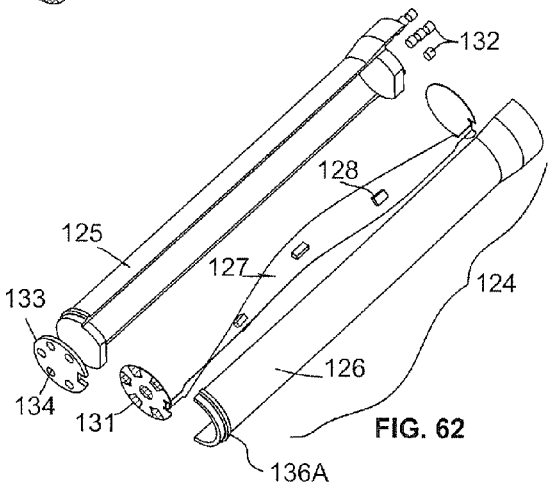
FIG. 62 is a diagrammatic representation of an exploded back isometric view of the selective switching module of FIG. 59.

The embodiment shown in FIGS. 59-65 is similar to the embodiment shown in FIGS. 54-58; however, it includes a segmented flexible magnetic contact construction, which allows selective switching within the module. FIGS. 59 and 60 are front and back isometric views, respectively, of a selective switching module 124. FIG. 61 is an exploded front isometric view of the selectable switching tubular lighting module 124 and FIG. 62 is an exploded back isometric view of the selectable switching tubular lighting module 124.

With reference to FIGS. 61 and 62, the module 124 includes a transparent tubular top housing 125, a bottom housing 126 (typically, an injection molded polymer), a flexible circuit 127 with components and light sources 128 (in this example the flexible circuit is shown twisted for purposes of providing 360 degrees of illumination from the light sources), segmented top contact pads 130, segmented bottom contact pads 131, multiple permanent magnets 132 (located behind the segmented contact pads 130), and ferromagnetic plate 133 (which may include small recesses 134 to provide a detenting action in conjunction with magnets 132).

Figure 63:
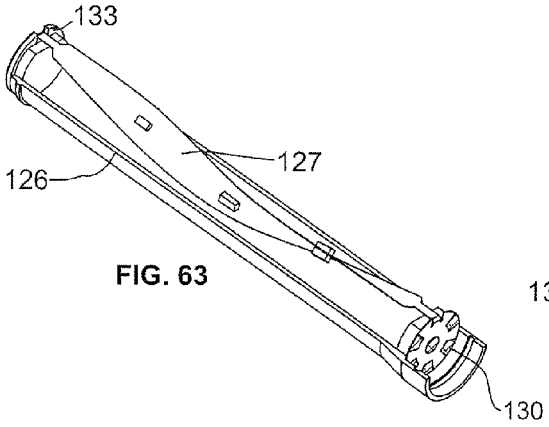
FIG. 63 is a diagrammatic representation of a front isometric view of a portion of the selective switching module of FIG. 59.
Figure 64:
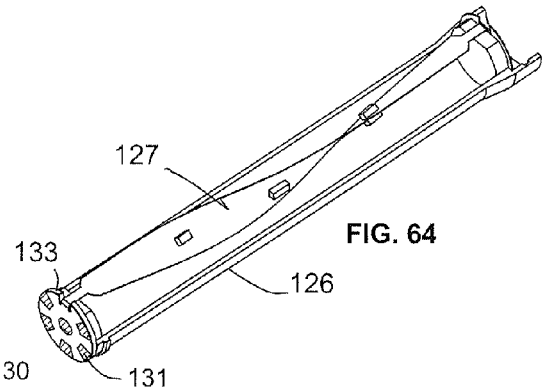
FIG. 64 is a diagrammatic representation of a back isometric view of a portion of the selective switching module of FIG. 59.

When assembled, the ferromagnetic plate 133 is attached to housing 126 with flex circuit contact pads 131 attached over the ferromagnetic plate 134. FIGS. 63 and 64 show front and back isometric views, respectively, of the bottom housing 126 with the flexible circuit 127, magnetic plate 133 and magnets 132 assembled.

With reference to FIGS. 61 and 62, magnets 132 are located loosely in cavities 135 with flexible circuit segmented contact pads 130 disposed over and entrapping magnets 132. As in the previous example discussion, mechanical retention features such as raised rib 136A and groove 136B may be incorporated to roughly locate and retain the tubular modules 124 when assembled.

Figure 65:
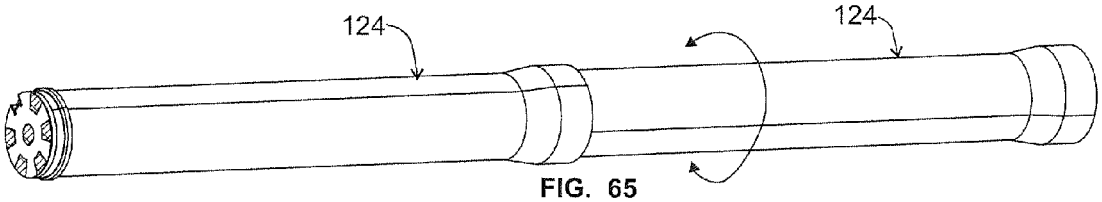
FIG. 65 is a diagrammatic representation of an isometric view of two selective switching modules that have been interconnected.

FIG. 65 shows two interconnected tubular switchable-lighted modules 124. Different electrical contact configurations may be selected by rotating one tubular module 124 such that different sets of the segmented contacts (130, 131) are aligned and actuated by the flexible magnetic interconnection. Such selectable switching may be useful for various control and operating modes of each module 124 or interconnected modules 124. Providing axially poled magnets on both ends of the assembly may be used to restrict the connection of certain pairs of contacts as described previously.

Figure 66:
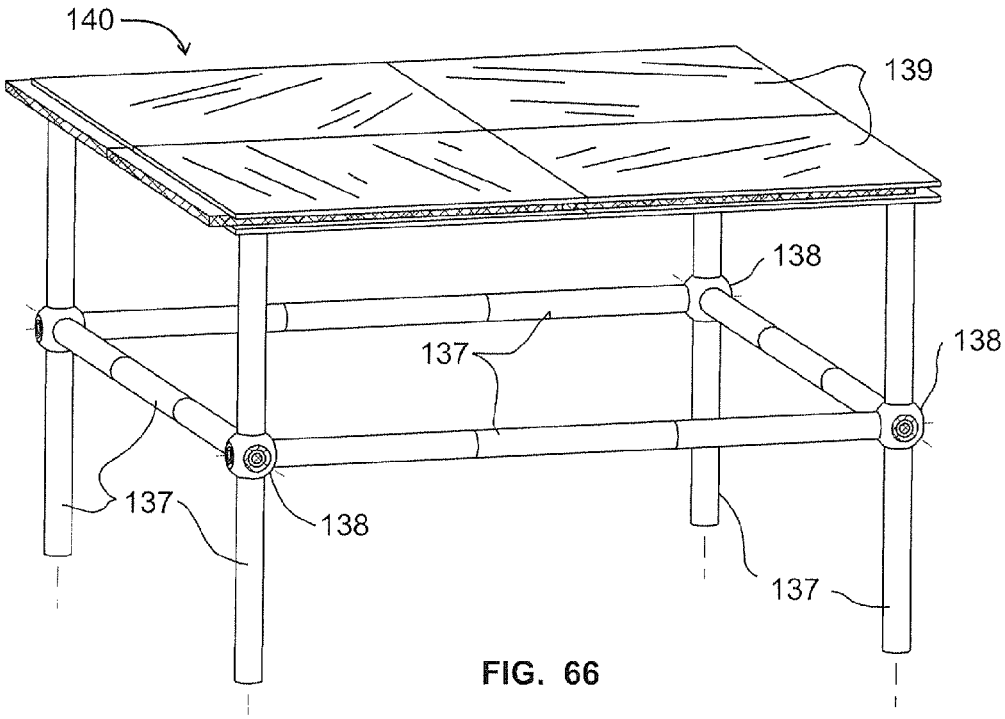
FIG. 66 is a diagrammatic representation of an isometric view of a structure comprised of tubular modules, spherical modules and plate-like modules.

FIG. 66 illustrates a structure 140 that includes tubular modules 137, spherical modules 138, and plate modules 139. The structure 140 may be used for display purposes, games, etc.

Figure 67:
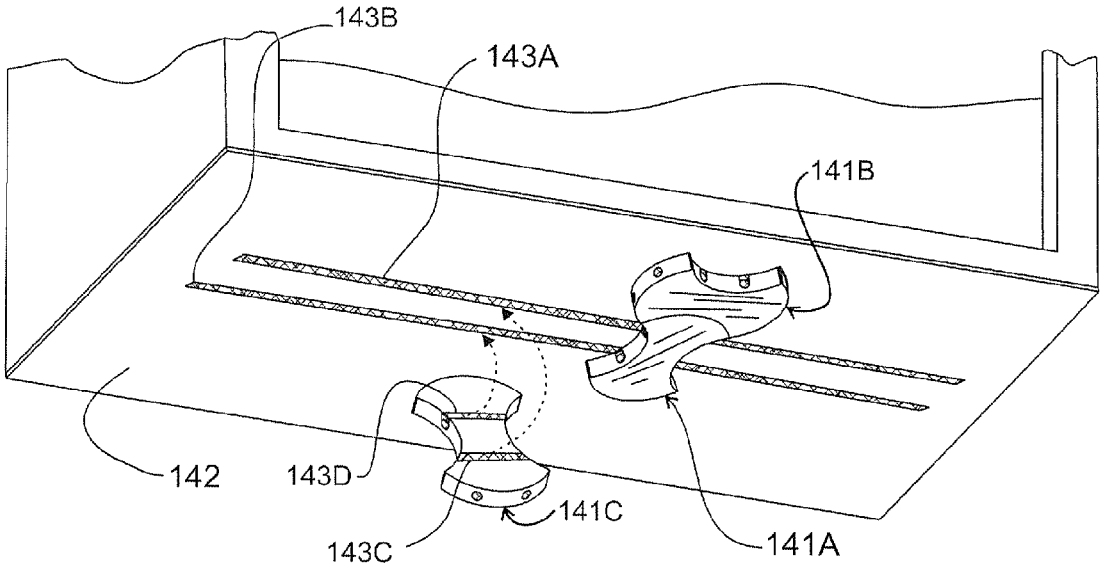
FIG. 67 is a diagrammatic representation of a portion of a ferromagnetic backing having lighted modules connected thereto.

FIG. 67 illustrates the use of lighted modules 141A, 141B, 141C in conjunction with a ferromagnetic backing to create custom configurable lighting for decorative or functional purposes, such as under cabinet lighting. A thin ferromagnetic sheet 142 with power supply circuits 143A (positive electrode) and 143B (negative electrode) attached thereon (e.g., a flexible printed circuit laminated to the ferromagnetic backing) allows interconnection of modules 141A, 141B, 141C magnetically to the backing, while simultaneously making an electrical connection for power to one or more modules 141A, 141B, 141C. The power supply circuit positive electrode 143A and negative electrode 143B are configured such that module 141C can be electrically connected to these electrodes through exposed positive electrode 143C and exposed negative electrode 143D, respectively, to provide power to the module 141C. It should be understood that modules 141A, 141B, 141C may supply power to adjacent modules that are not directly connected to the power supply circuit electrodes 143A and 143B. As shown, module 141A is supplying power to 141B.

The same magnets utilized in the flexible magnetic interconnection between adjacent modules may be used to retain the modules to the ferromagnetic backing 142. In one embodiment, additional discrete magnets that increase mechanical attraction to the ferromagnetic backing 142 may be added to the modules 141. The ferromagnetic backing plates 142 may be easily installed by providing a thin steel sheet that has an adhesive backing with inexpensive thin circuitry adhesively applied or laminated to the ferromagnetic backing. This steel sheet may be cut or broken at perforations to aid with customization. As an alternative, a paint coating that includes ferromagnetic particles may be applied to the surface and thin circuitry may be adhered to this ferromagnetic coating for forming a ferromagnetic backing 142. In other embodiments, the ferromagnetic backing 142 may also be replaced with a plastic magnetic sheet with thin circuitry that may be easily cut with scissors.

Figure 68:
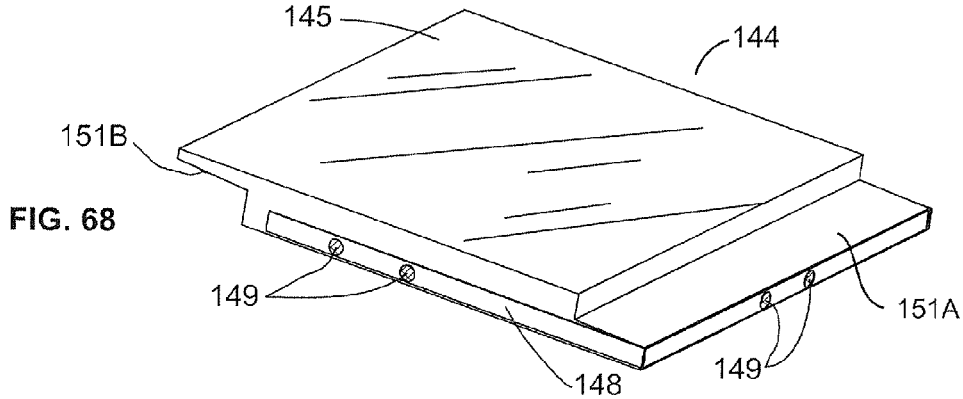
FIG. 68 is a diagrammatic representation of an isometric view of a modular backlighting tile that has a flexible magnetic interconnector.
Figure 69:
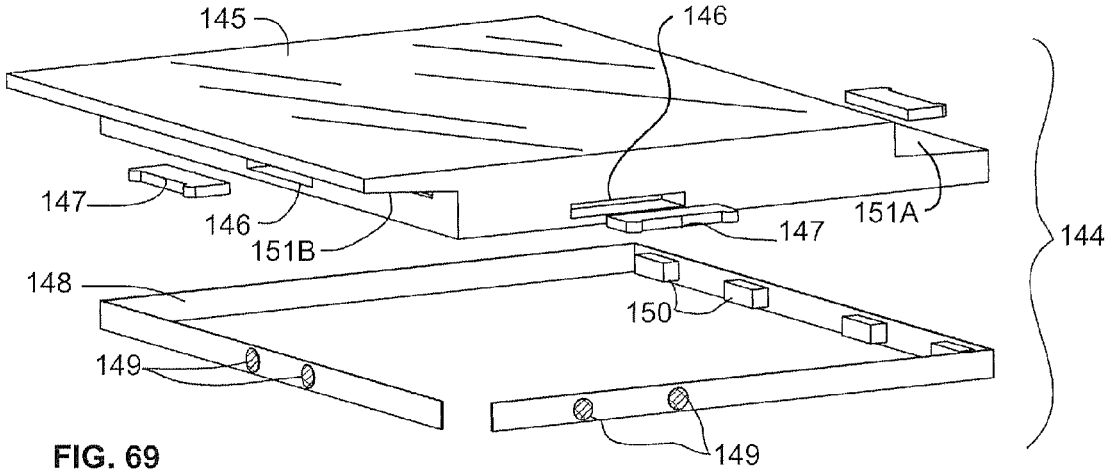
FIG. 69 is a diagrammatic representation of an exploded isometric view of the backlighting tile of FIG. 68.
Figure 70:
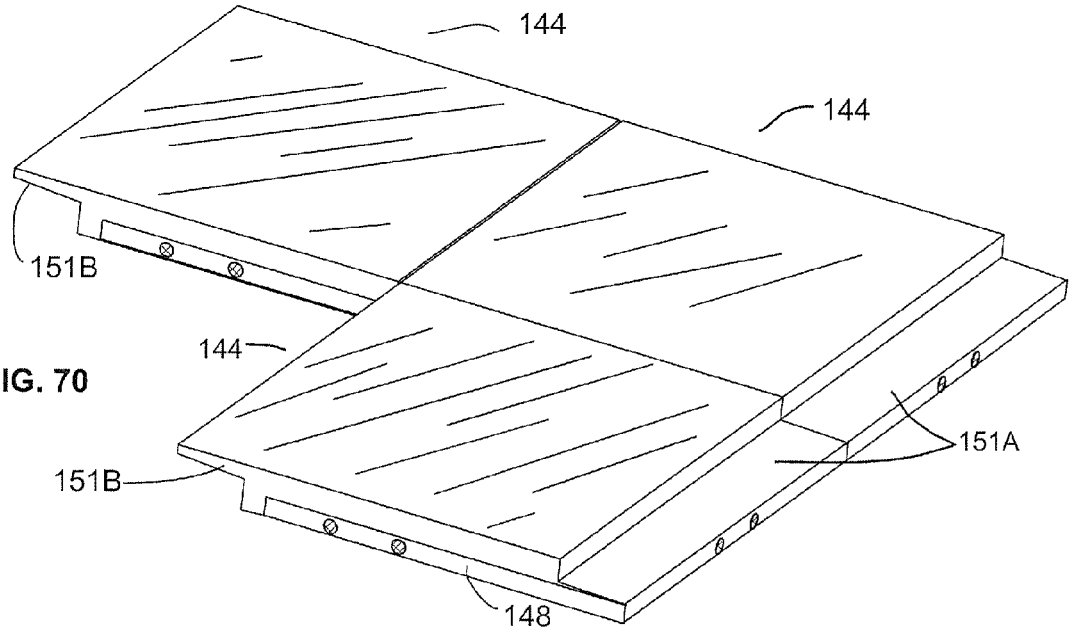
FIG. 70 is a diagrammatic representation of an isometric view of three modular backlighting tiles that have been interconnected.

FIGS. 68-70 illustrate a modular backlighting tile 144 using the flexible magnetic interconnection. A light guide 145 that is molded of transparent polymer such as acrylic, has a light source overlapping region 151A and end overlapping region 151B that obscures the light sources 150 of adjacent modules when the modules 144 are interconnected. There would typically be an opaque white or metallized reflector (not shown in the figures) located on the back side of light guide 145. This opaque reflector would obscure any undesired light from light-sources 150 when modules are assembled in an array. Other masking techniques such as painting or opaque tapes over the light sources may also be utilized to block undesired light.

The front and/or back surfaces of the light guide 145 may be provided with a graded texture such as grooves, painted diffuser dots, embossed dots, etc., that diffuses/refracts/reflects the light into the viewing direction in a uniform light distribution. The light guide 145 has features 146 to retain permanent magnets 147 but allow movement of the magnets, and a flexible circuit 148 with contact pads 149, components and LEDs 150. The light guides 145 typically would include light sources 150 along one edge, with the graded reflecting/refracting/diffusing structure less dense near the sources 150.

The flexible circuit 148 is attached to the light guide 145 with suitable methods such as adhesive bonding.

This example shows a single shaped magnet 147 allowing connection to two contact pads 149. When backlighting tiles 144 are interconnected (see FIG. 70), overlapping ends 151B and 151A obscure the light sources of adjacent modules. This interconnection method and construction has significant advantages over other possible ways of constructing such modules. For example, a typical design approach might utilize rigid a PCB with light sources attached, "tongue" PCB contacts on two adjacent edges, and spring contacts on the other two adjacent edges. This PCB and conventional contact method utilizes much more PCB material and greatly restricts the orientation and method of assembly to engage the tongues and recessed contacts. Furthermore, the mechanical contacts are subject to damage and require tight tolerances on all parts to function correctly. Using the subject flexible magnetic interconnection, no tight tolerances are required, the modules may be connected in any sequence (they even provide the ability to remove modules vertically from an array) and very little circuit area is required.

Figure 71:
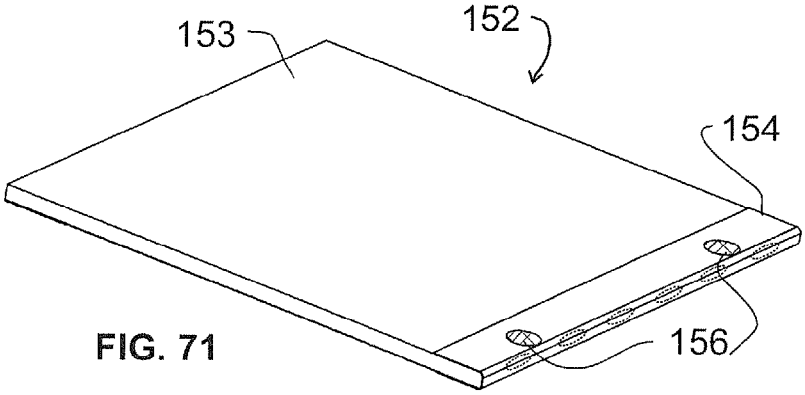
FIG. 71 is a diagrammatic representation of a top isometric view of a lighting module in accordance with another embodiment of the present invention.
Figure 72:
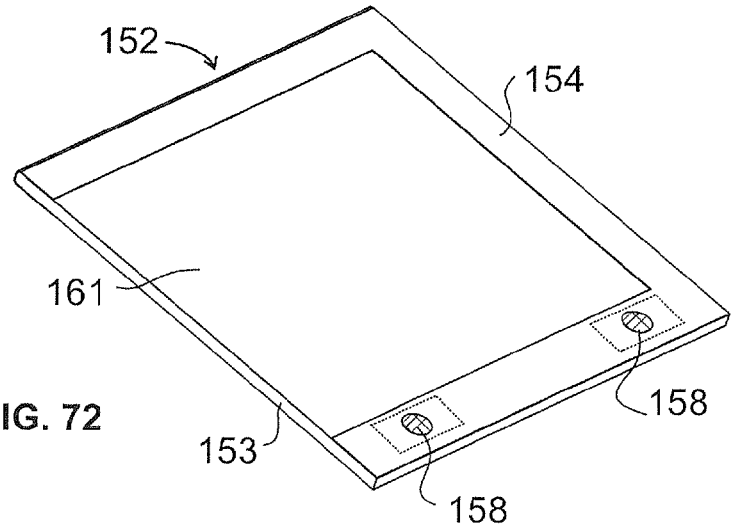
FIG. 72 is a diagrammatic representation of a bottom isometric view of the lighting module of FIG. 71.
Figure 73:
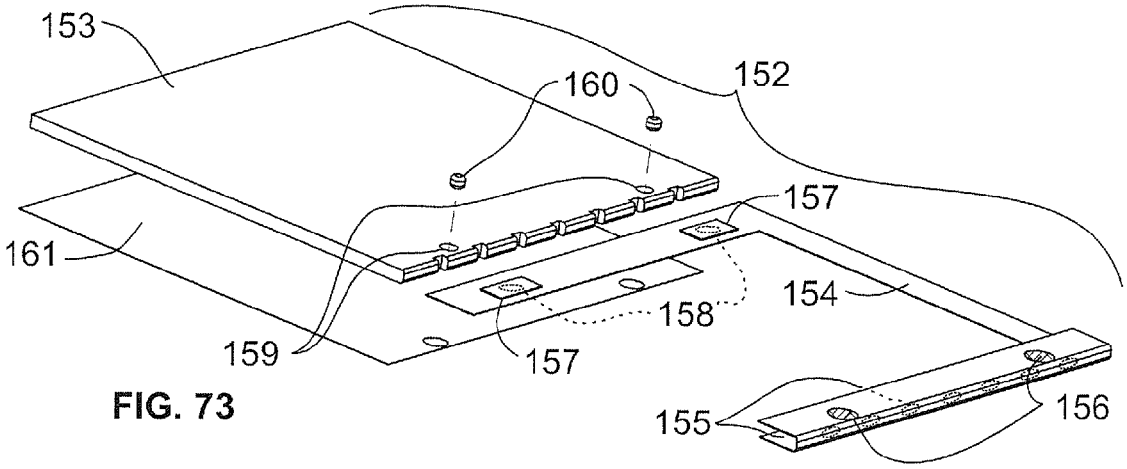
FIG. 73 is a diagrammatic representation of a top exploded isometric view of the lighting module of FIG. 71.

FIGS. 71-76 illustrate another embodiment of a lighting module 152 suitable for backlighting and other applications. FIG. 71 is a top isometric view of the lighting module 152 and FIG. 72 is a bottom isometric view of the lighting module 152. In addition, FIG. 73 is a top exploded view of the lighting module 152.

As shown in FIGS. 71-73, the lighting module 152 includes a light guide 153 that may be very thin (~0.04 inch thick) and flexible, and may be made of low durometer transparent elastomers such as clear PVC film or rigid transparent polymers such as acrylic. The light guide 153 may be stamped and embossed from sheet material, or may be injection molded. The lighting module 152 uses a light guide 153 with suitable diffusing/reflecting structures on its top and/or bottom surfaces (usually a graded texture or white painted dots that are less dense at the light source end). Flexible circuit 154 includes light sources such as LEDs 155 located on the flexible circuit 154 to correspond with one edge of the light guide 153. Other components of the lighting module 152 include top vertical contact pads 156, ferromagnetic plates 157 bonded to the flexible circuit (alternately, ferromagnetic plates 157 may be attached to the diffusor and/or light guide), and bottom contact pads 158 located opposite the ferromagnetic plates 157 on the flexible circuit 154. Furthermore, the lighting module 152 has pockets 159 (in light guide 153) to loosely trap magnets 160. A diffusing sheet 161 or other brightness enhancement films may also be incorporated to increase light output efficiency. The flexible circuit 154 is attached to the light guide 153 such that the magnets 160 are entrapped in the pockets 159 adjacent to the top contact pads 156.

Figure 74:
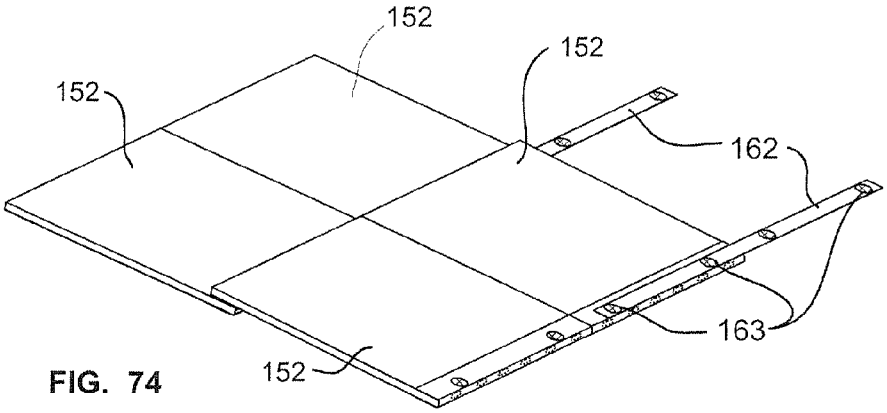
FIG. 74 is a diagrammatic representation of a top isometric view of four interconnected lighting modules.
Figure 75:
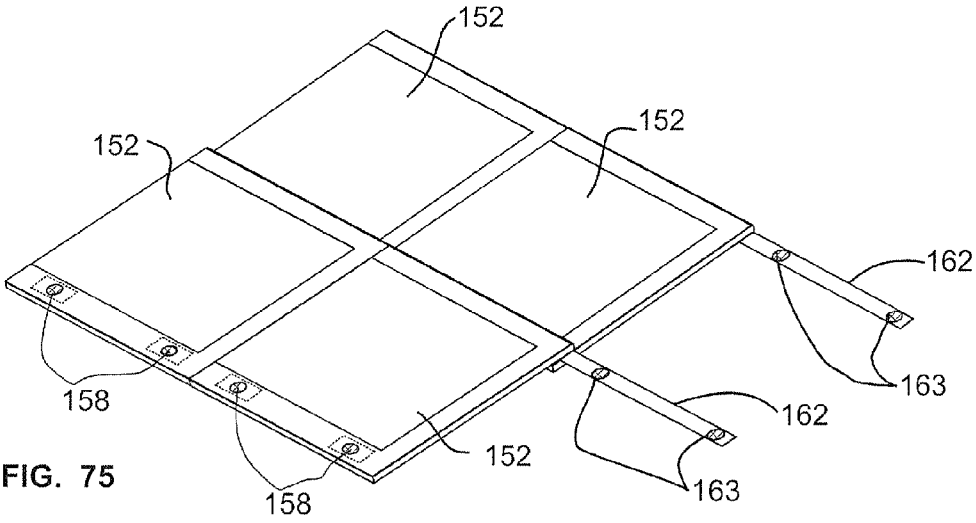
FIG. 75 is a diagrammatic representation of a bottom isometric view of four interconnected lighting modules.

FIGS. 74 and 75 illustrate a top and bottom isometric view, respectively, of four connected lighting modules 152. To mechanically and electrically interconnect multiple modules 152, the opposite ends of adjacent modules are simply overlapped, whereby the magnets 160 are attracted to the overlapping end's ferromagnetic plate 157. This causes the flexible top contacts 156 and bottom contacts 158 to be compressed (or deformed), thereby mechanically and electrically connecting adjacent modules 152.

For connections in orthogonal directions, simple bussing strips 162 of flexible circuit material with contacts 163 may be inserted between the connected modules 152, whereby the bussing strip contacts 163 are compressed and electrically connected to the top and bottom contacts 156, 158. Such buss structures may also be incorporated into the base flexible circuit 154. The flexible circuits 154 may be of many configurations to increase material efficiency, and may even be of folded designs such that substantially linear flexible circuit outlines may be utilized. This embodiment may be thin and flexible such that extended arrays may be wrapped onto compound surfaces.

Figure 76:
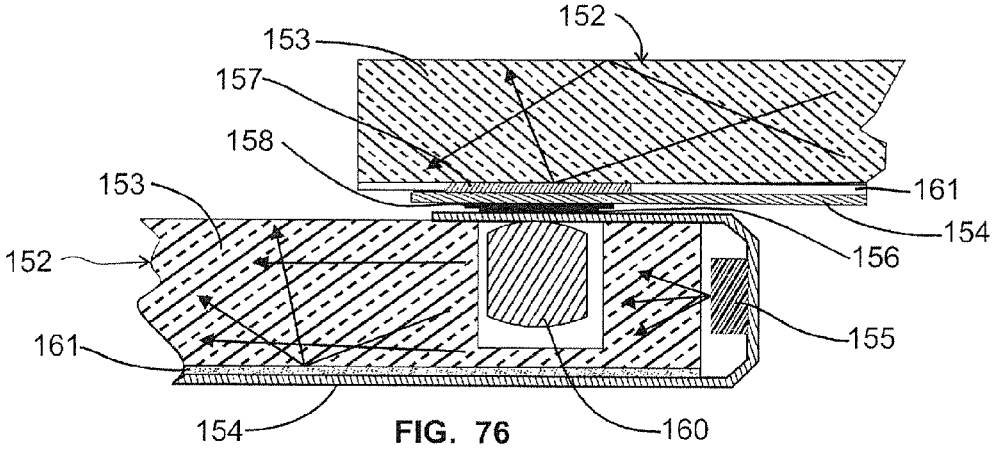
FIG. 76 is a diagrammatic representation of a cross-sectional view of two overlapping interconnected lighting modules.

FIG. 76 shows a cross-sectional view through the overlapping contact area (with bussing strips 162 not shown, and light rays propagating thought the light guide denoted by arrows). The overlapping regions obscure the contacts and light sources of the adjacent module 152, providing a uniformly illuminated viewing surface without discontinuities or hot spots.

Figure 77:
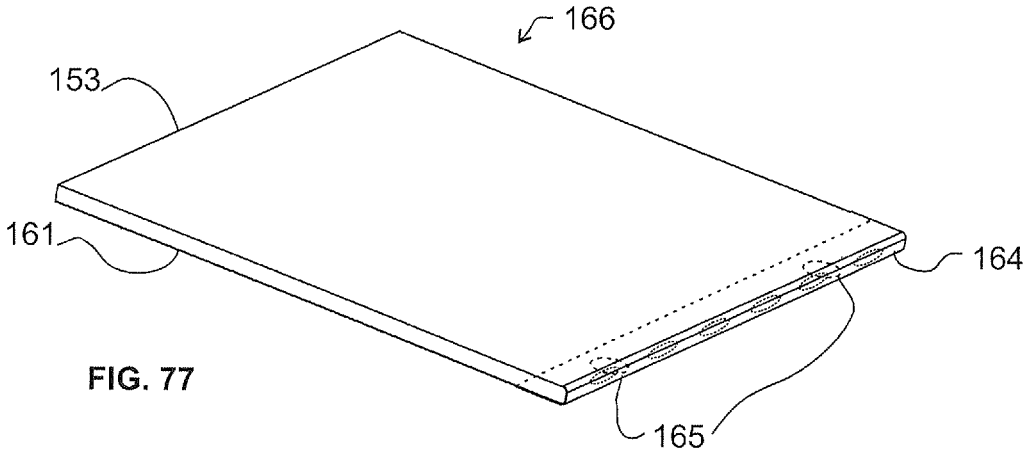
FIG. 77 is a diagrammatic representation of a top isometric view of a module in accordance with another embodiment of the present invention.
Figure 78:
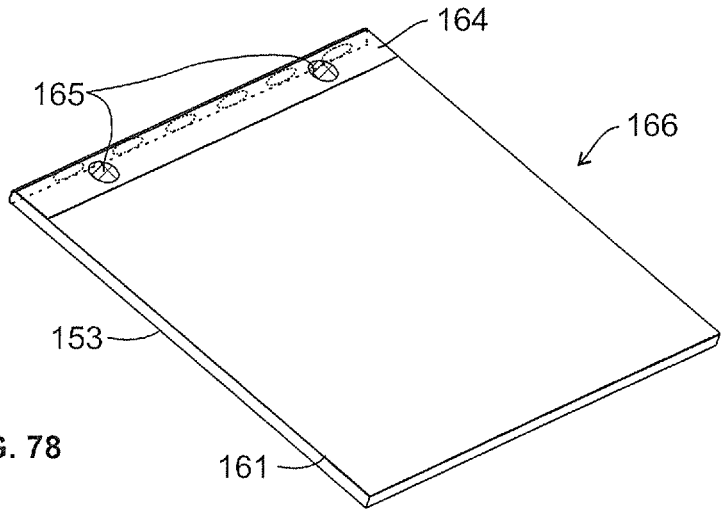
FIG. 78 is a diagrammatic representation of a bottom isometric view of the module in FIG. 77.
Figure 79:
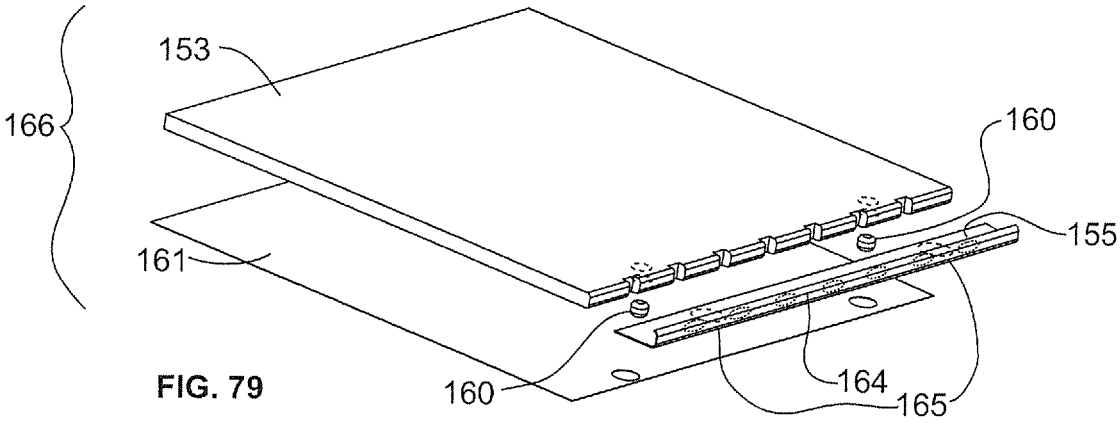
FIG. 79 is a diagrammatic representation of a top exploded isometric view of the module in FIG. 77.

FIGS. 77-81 show another embodiment of a module, which is similar to the embodiment of the module shown in FIGS. 71-76; however, it is constructed to be electrically attached to a ferromagnetic backplane or electrodes with a ferromagnetic component. FIG. 77 is a top isometric view of a backplane module 166 and FIG. 78 is a bottom isometric view of the backplane module 166, which shows bottom contacts 165 (with magnets 160 located behind contact pads 165). FIG. 79 illustrates a top exploded view of backplane module 166.

With reference to FIGS. 77-79, the backplane module 166 includes a light guide 153, optional diffusor sheet 161, magnets 160, a flex circuit 164 including LEDs 155 (located on the inner surface of the flex circuit in the illustration as denoted by dashed ellipses), and contact pads 165 located on the back side of the module 166 and aligned with magnets 160. In this embodiment, the magnets 160 may be retained in a blind hole and inserted from the rear surface of light guide 153. The assembly is joined with suitable mechanical and/or adhesive means.

Figure 80:
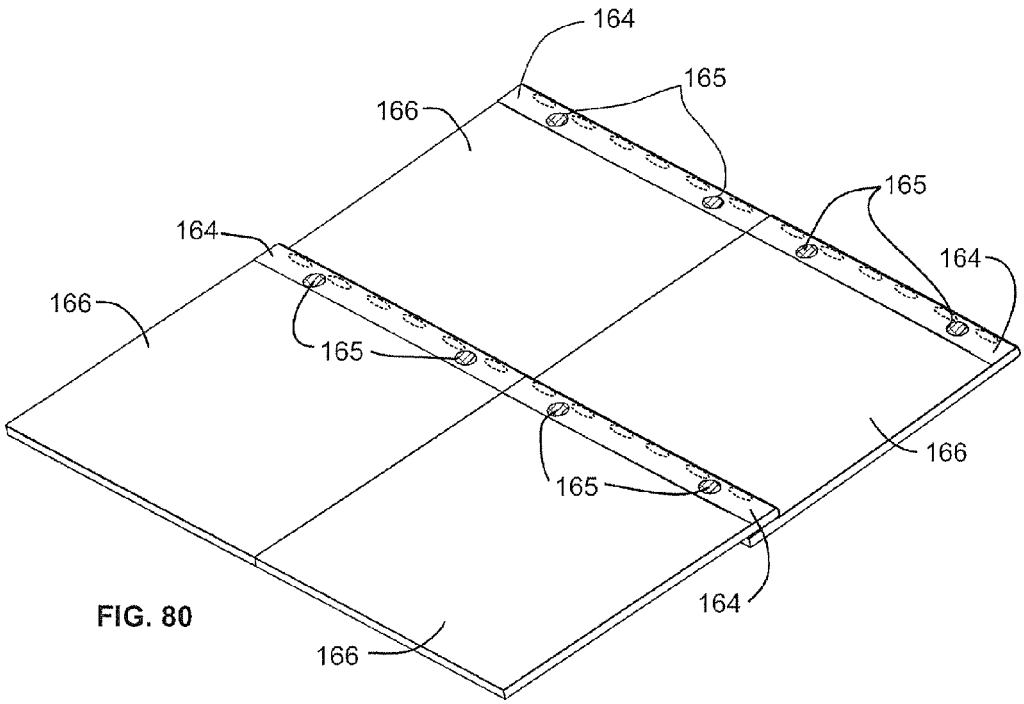
FIG. 80 is a diagrammatic representation of a bottom isometric view of four backplane modules placed adjacent to one another, but not connected to a ferromagnetic backplane assembly; and, FIG. 81 is a diagrammatic representation of a top isometric view of four backplane modules placed proximate to a ferromagnetic backplane assembly.
Figure 81:
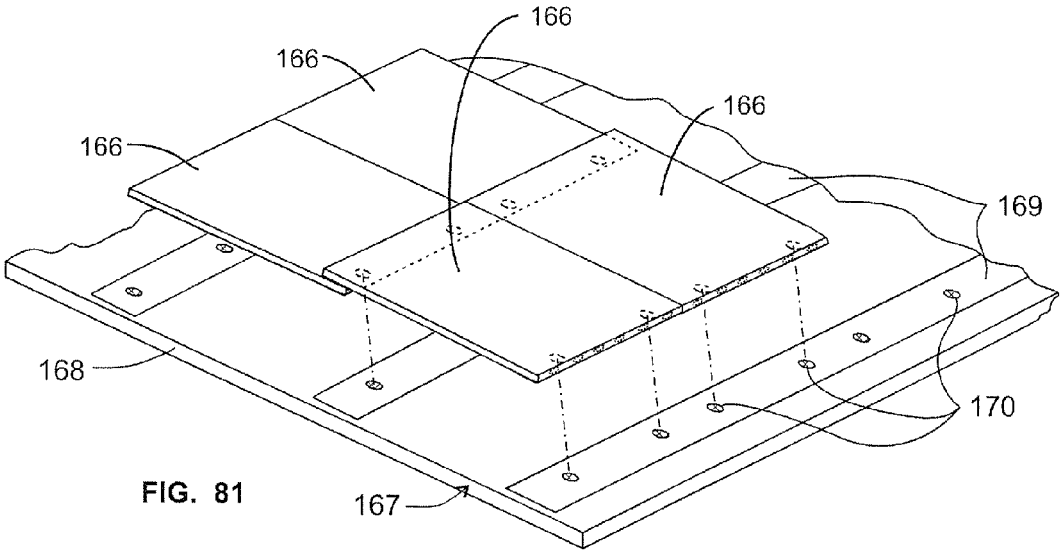

FIG. 80 shows a bottom isometric view of four backplane modules 166 placed adjacent to one another in their overlapping configuration not yet connected to ferromagnetic backplane 168 (FIG. 81). FIG. 81 shows ferromagnetic backplane assembly 167, comprised of a ferromagnetic sheet or backing 168, to which thin circuitry 169 with contact pads 170 are attached.

Thin circuitry 169 may be flexible circuitry or thin laminate materials such as epoxy glass, and may be a continuous sheet or segmented as shown. Stamped and freestanding electrodes, such as rods, may be utilized instead of the backplane 168 illustrated.

Backplane contact pads 170 are provided which align with the contact pads 165 of backplane modules 166. When backplane modules 166 are placed onto ferromagnetic backplane assembly 167, magnets 160 are attracted to the ferromagnetic backing 168, and compress the module contact pads 165 and ferromagnetic backplane contact pads 170, producing electrical contact and mechanical retention. There may be many contacts per module and the contacts may have different geometries.

LEDs 155 may be top emitting and the flexible circuit 164 may be folded in a right-angle configuration to direct light into the edge of the light guide 153 as shown in FIGS. 77-81. Alternatively, LEDs 155 may be side emitting, whereby the fold in flexible circuit 164 is not necessary. Variations of the designs of FIGS. 71-73 and 77-79 may include the overlapping of two adjacent edges with light sources.

The aforementioned examples and discussions describe electrical contact being made by directly compressing flexible printed circuit contact elements between permanent magnets and/or permanent magnets and ferromagnetic parts. However, electrical contact may also be accomplished by compression of contact features that are not directly adjacent to or between the magnetic materials. For example, contact bumps, flexible leaf members, or discrete contacts applied to a flexible or semi-rigid printed circuit with or without polymeric substrates in the contact area may be interconnected, even if these features are not located directly adjacent to the magnetically attracted features. Contact structures that extend beyond the mechanical contact surface may be compressed and electrical contact established by magnetic attraction at other positions on the contact surfaces. Slits, tabs, and/or the addition of intermediate flexible backing materials under the contact pad, or other features may be incorporated into the contact elements to tailor the deflection/compliance of the contact pads.

Flexible printed circuits, semi-flexible printed circuits, and combination rigid-flexible circuits may be utilized, as well as conventional PCBs, and stamped metal constructions for circuitry.

A wide range of magnet materials may be utilized, including rare-earth magnets, "plastic" rare earth magnets, sintered and cast high-energy magnets such as Nd—Fe—B and Alnico. Use of multiple magnets, strips of alternately magnetized magnets (such as plastic magnets) combined with appropriately shaped contacts allows modules to be positioned in multiple random locations (for example, two square modules that may be positioned anywhere along adjacent edges). Magnets and ferromagnetic parts may be coated with other materials such as polymers to control wear, friction, abrasion, electrical insulation, electrical conductivity, or to modify the shape of the basic magnet for functional and/or cost improvement.

Flex circuit attachment may be by liquid adhesives, solvent bonding, heat-staking or heat staking onto pins or other features, mechanical interlocking onto pins, slots or tabs, pressure sensitive adhesive, thermoplastic adhesive (hot melt liquids, tapes, etc.), epoxy or other thermoplastic or thermosetting tapes or liquids, thermal bonding, ultrasonic bonding, etc. The circuitry and contact pads may be slightly recessed with respect to the body of the module as a result of the motion of the contacts under the magnetic force. As a result, contacts 66 in an extended membrane described above for FIG. 30 or equivalent contacts in membrane 81 in FIG. 36 could be recessed below the top surface of the membrane plane.

This invention is applicable to other areas where non-planar packaging may be desired such as (military applications such as missiles) configurable radomes or modular antennas.

This invention is particularly applicable to decorative and functional lighting applications, and several illustrative examples of the broad inventive concepts have been provided here. Many different processes may be used in decorative and functional lighting applications to diffuse, reflect, or preferentially direct light including light guides with laser engraving on the front and/or back, three-dimensional laser volume engraving or scattering elements, molded features, painting or other surface decoration methods, in-mold decorating, reflective films or paints, etc. Light guides and/or cavity constructions with light sources may be used. Since modules may be transparent (and viewable from multiple sides) with a visible pattern on only a portion of the faces or internally, multiple layers of modules may be stacked or placed behind one another to form three-dimensional structures having different patterns and colors. These layers may be removably connected, or semi-permanently fixed together with mechanical attachment and/or adhesive bonding means.

Large modular structures such as large blocks may be constructed that are self-supporting when assembled. Modules may use auxiliary magnetic connections that are not used for electrical contact where appropriate, or other mechanical interlocking and keying means.

Since this invention allows mechanically flexible electrical interconnections, assemblies of modules also retain some flexibility, allowing unique applications such as curtain-like movable structures, and assemblies that may be wrapped onto compound surfaces and remain electrically and mechanically interconnected. In the case of a linear chain of modules, use of a single magnet pair on the connecting edge would allow rotation of the modules. Providing multiple electrical contacts under this geometry would require contact geometries with appropriate circular symmetry for the range of angles allowed.

The subject invention can also be used to electrically and mechanically interconnect soft, low durometer materials such as elastomers or soft plastics (for example, in the construction of bendable lighting applications where soft light transmitting polymers may be utilized). Since the flexible substrates disclosed may be translucent, and since translucent electrical conductors such as indium tin oxide are available, light from one module may be transmitted into adjacent modules through parts of the flexible circuitry.

Although the discussion has concentrated on the magnetic force that results in electrical contact between modules, this magnetic force may also be used to attach an array of modules to a supporting ferromagnetic or magnetic surface. For example, a planar array of lighting modules may be held in position to a sheet of ferromagnetic material forming a horizontal surface under the influence of the magnetic attraction from the magnets in individual modules. Of course, with sufficient magnetic force, the array of modules could be removably fixed to a ferromagnetic sheet fixed to vertical or horizontal surfaces like walls or ceilings. Due to the flexibility in the contacts, there is no restriction to fix arrays of modules to planar surfaces. The relative size of the individual modules and the range of motion while maintaining electrical contact will determine the minimum local curvature of the supporting substrate to which the array of modules could be attached.

Several embodiments of the invention have been described. It should be understood that the concepts described in connection with one embodiment of the invention may be combined with the concepts described in connection with another embodiment (or other embodiments) of the invention.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A system comprising:

a first module including at least one first magnetic structure, a frame and a circuit comprising at least one compliant contact that has a shape that is changed by movement of the first magnetic structure wherein the first magnetic structure is moveable substantially within the frame of the first module;

a second module including at least one second magnetic structure and a circuit, wherein a magnetic attraction between the first magnetic structure and the second magnetic structure creates movement of the first magnetic structure and causes the compliant contact of the first module to change shape.

2. The system of claim 1, wherein the circuit of the first module and circuit of the second module are electrically connected by the magnetic force.

3. The system of claim 1, wherein the first module includes at least one element that radiates electromagnetic energy.

4. The system of claim 3, wherein the first module includes a light guide.

5. The system of claim 1, wherein the frame comprises a material that provides a heat sink for electronic components.

6. The system of claim 1, wherein the frame comprises a flexible material.

7. The system of claim 6, wherein the frame changes shape through magnetic attraction between the first magnetic structures and the second magnetic structures.

8. The system of claim 1, wherein compliant contacts are arranged in a substantially planar array.

9. The system of claim 8, wherein the second magnetic structure comprises a substantially planar element.

10. The system of claim 8, wherein one first magnetic structure is associated with each compliant contact.

11. The system of claim 8, wherein the substantially planar array of compliant contacts does not possess rotational symmetry.

12. A system comprising:

a first module including a first magnetic structure and a circuit comprising;

a compliant contact that has a shape that is changed by movement of the first magnetic structure, wherein the first magnetic structure is moveable substantially within the first module;

a substrate including a second magnetic structure, wherein a magnetic attraction between the first magnetic structure and the second magnetic structure creates movement of the first magnetic structures and causes the compliant contact of the first module to change shape.

13. The system of claim 12, wherein an electrical connection is formed between the circuit of the first module and the circuit of the substrate.

14. The system of claim 12, wherein the substrate includes a membrane switch.

15. The system of claim 12, wherein the first module includes a light source.

16. A method comprising the steps of: providing a first module including a first magnetic structure and a first circuit comprising a compliant contact that has a shape that is changed by movement of the first magnetic structure, wherein the first magnetic structure is moveable substantially within the first module; applying a magnetic force, thereby causing the first magnetic structure to move and the compliant contact to change shape.

17. The method of claim 16 in which the magnetic force is provided by a second module including a second magnetic structure and a second circuit.

18. The method of claim 17 in which an electrical connection is formed between the compliant contact of the first module and the second circuit.

19. The method of claim 18 in which the movement of the first magnetic structure activates a membrane switch in the second module.

20. The method of claim 19 in which electrical current flows to the first module from the second circuit through the membrane switch.

* * * * *